US007077128B2

(12) United States Patent
Wilson et al.

(10) Patent No.: US 7,077,128 B2
(45) Date of Patent: Jul. 18, 2006

(54) EYE-WEAR ARTICLES FOR USE WITH RESPIRATORY MASKS

(75) Inventors: Audra A. Wilson, Tyne & Wear (GB); Christopher P. Henderson, County Durham (GB); Desmond T. Curran, County Durham (GB); Brian Cormack, County Durham (GB)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/611,179

(22) Filed: Jul. 1, 2003

(65) Prior Publication Data

US 2004/0069302 A1 Apr. 15, 2004

(30) Foreign Application Priority Data

Jul. 15, 2002 (GB) ..... 0216284.0

(51) Int. Cl.
*A62B 17/04* (2006.01)
*A62B 18/00* (2006.01)

(52) U.S. Cl. ..... 128/201.24; 128/206.23; 128/858; 128/206.22; 2/15; 2/427

(58) Field of Classification Search ..... 128/857, 128/858, 201.14–201.17, 201.22, 201.23, 128/201.24, 205.27, 206.12, 206.21, 206.23; 2/15, 426–429, 431, 441, 445, 446, 6.3–6.5, 2/6.7, 448–454; D29/110
See application file for complete search history.

(56) References Cited

U.S. PATENT DOCUMENTS 2,462,005 A 2/1949 Schauweker
2,740,400 A * 4/1956 Wines ..... 128/146
2,762,368 A 9/1956 Bloomfield
3,971,368 A * 7/1976 Forbes et al. ..... 128/201.15
4,109,320 A 8/1978 Anderson
4,126,131 A 11/1978 Davis et al.
4,172,455 A 10/1979 Beaussant
4,419,994 A 12/1983 Hilton
4,479,738 A 10/1984 Kubnick
4,600,002 A 7/1986 Maryyanek et al.
4,701,965 A 10/1987 Landis
4,883,547 A 11/1989 Japuntich
4,944,294 A 7/1990 Borek, Jr.

(Continued)

FOREIGN PATENT DOCUMENTS

DE 3630516 3/1988

(Continued)

*Primary Examiner*—Henry Bennett
*Assistant Examiner*—Amanda Wieker
(74) *Attorney, Agent, or Firm*—Karl G Hanson; Kevin W. Raasch

(57) ABSTRACT

An eye-wear article (93) for use with a respiratory mask (1) comprises a flat piece of transparent polymeric material providing a visor portion. The flat piece of polymeric material has shaped portions in a lower edge that fit over respective selected parts of the mask, and elongate tabs (95) that extend from each side and are inserted into respective guides (97) on the head harness (7, 8) of the mask to cause the flat piece of polymeric material to adopt a curved configuration and locate the visor portion in front of the eyes of the wearer. The tabs (95) can slide in the guides (97) to permit the eye-wear article to be moved out of engagement with the mask and onto the top of the wearer's while the mask is being worn, without disturbing the position of the mask on the wearer's face and without affecting the respiratory protection provided by the mask.

44 Claims, 18 Drawing Sheets

U.S. PATENT DOCUMENTS

| | | | | | |
|---|---|---|---|---|---|
| 4,945,574 | A | | 8/1990 | Dagher | |
| 4,964,171 | A | | 10/1990 | Landis | |
| 4,965,887 | A | | 10/1990 | Paoluccio et al. | |
| 5,020,533 | A | | 6/1991 | Hubbard et al. | |
| 5,185,889 | A | | 2/1993 | Kamata | |
| 5,303,423 | A | | 4/1994 | Gazzara et al. | |
| 5,374,458 | A | | 12/1994 | Burgio | |
| 5,406,943 | A | * | 4/1995 | Hubbard et al. | 128/206.12 |
| 5,406,944 | A | | 4/1995 | Gazzara | |
| 5,446,925 | A | | 9/1995 | Baker et al. | |
| 5,584,078 | A | * | 12/1996 | Saboory | 2/427 |
| 5,630,412 | A | | 5/1997 | Dubruille et al. | |
| 5,666,671 | A | | 9/1997 | Daneshvar | |
| 5,682,879 | A | | 11/1997 | Bowers | |
| 5,689,833 | A | | 11/1997 | Allen et al. | |
| 5,694,925 | A | * | 12/1997 | Reese et al. | 128/206.19 |
| 5,704,073 | A | | 1/1998 | Sword et al. | |
| 5,704,349 | A | | 1/1998 | Hubbard et al. | |
| 5,987,651 | A | | 11/1999 | Tanaka | |
| 6,026,511 | A | * | 2/2000 | Baumann et al. | 2/9 |
| 6,085,748 | A | * | 7/2000 | Sword et al. | 128/206.23 |
| 6,216,695 | B1 | * | 4/2001 | Ruben | 128/206.19 |
| 6,264,392 | B1 | | 7/2001 | Wise et al. | |
| 6,401,716 | B1 | * | 6/2002 | Sword et al. | 128/206.21 |
| 6,687,910 | B1 | * | 2/2004 | Smallwood | 2/15 |
| 6,823,868 | B1 | * | 11/2004 | Begum | 128/206.19 |

FOREIGN PATENT DOCUMENTS

| | | |
|---|---|---|
| DE | 9401066 | 4/1994 |
| EP | 0 650 712 A | 5/1995 |
| EP | 1086720 | 3/2001 |
| JP | 7-216622 | 8/1995 |
| WO | WO 96/28217 | 9/1996 |
| WO | WO 96/34658 | 11/1996 |
| WO | WO 97/04837 | 2/1997 |
| WO | WO 99/06116 | 2/1999 |
| WO | WO 99/29195 | 6/1999 |
| WO | WO 01/72156 | 10/2001 |

* cited by examiner

EYE-WEAR ARTICLES FOR USE WITH RESPIRATORY MASKS

This application claims priority to Great Britain Serial No. 0216284.0, filed Jul. 15, 2002.

The present invention relates to eye-wear articles for use with respiratory masks.

BACKGROUND

Respiratory masks are worn in environments where toxic or noxious contaminants are present in the air, for example paint spraying booths. The masks are worn to protect the wearer from inhaling the airborne contaminants. In some activities, flying particles, droplets, or other contaminants can be generated. These airborne materials may irritate a person's eyes, and therefore it is advisable that eye protection, as well as respiratory protection, be worn. A respiratory mask may be used, which covers the whole wearer's face or head, or when the mask itself does not provide eye protection, by using separate eye shields, goggles, or glasses.

When using eye protection, a respirator wearer's vision can be impaired if the viewing area of the eye protection becomes obscured, for example, as a result of being struck by flying particles or droplets. This particular risk may occur during certain activities, for example, paint spraying. For those activities, eye protection that is separate from the respiratory mask may be more attractive because it can be changed more easily if it becomes damaged.

Separate eye protectors, however, can also present problems for respirator wearers. One problem is that the eye protectors can mist up during use (because they may trap, or provide an escape route for, warm air from the mask or, in the case of goggles, simply because they seal tightly to the face) thereby also obscuring wearer vision. They also are not always easy to fit or remove when wearing a respiratory mask. Another problem can be a lack of compatibility between the eye protector and the respiratory mask. This situation particularly arises when the respirator wearer attempts to don goggles or glasses to protect his/her eyes. In order to fit the goggles/glasses correctly, the wearer may compromise the fit of the half-mask to the face by locating the goggles/glasses below the mask seal. Alternatively, the wearer may choose to compromise the fit of the goggles/glasses by locating the bridge of the goggles/glasses over the nose portion of the mask, which can lead to distorted vision, misting, and discomfort.

Many different eye/face protectors have been proposed, examples of which are described in U.S. Pat. Nos. 4,701,965, 4,945,574, 4,964,171, 4,965,887, and 5,666,671. U.S. Pat. No. 6,264,392 describes a pivot joint assembly that enables a face shield, used either on its own or in combination with a helmet, to be moved by the wearer through a number of pre-selected indexed positions between a fully-up position and a fully-down position. Protective helmets with pivotal visors are described in U.S. Pat. Nos. 4,109,320, 4,479,738, 5,185,889, and 5,987,651; German Patents 3630516 and 9401066; and Japanese Patent 7-216622.

There also have been proposals for combining eye protection with respiratory half masks, examples of which are described in U.S. Pat. Nos. 2,462,005, 2,740,400, 2,762,368, 3,971,368, 4,172,455, 5,630,412, and 5,682,879; International Applications WO 96/34658 and WO 97/04837; and European Patent 1,086,720. The disclosures of the documents are summarized briefly below:

U.S. Pat. No. 2,462,005 describes a face shield for a half mask that has a centrally-located inhalation filter cartridge and a centrally-located exhalation valve. The face shield is a flat piece of flexible transparent material, with an opening and associated straps formed in its lower edge to enable the face shield to be fitted onto the filter cartridge.

U.S. Pat. No. 2,740,400 describes a face shield for a half mask that has a central exhalation valve and two inhalation filters mounted on receptacles in the cheek regions of the mask. The face shield is pre-shaped to curve over the eye region of the wearer, and has two apertures positioned to fit over the filter receptacles before the filters are attached.

U.S. Pat. No. 2,762,368 describes an eye shield for use with a non-valved half mask. The eye shield is a flat piece of flexible, transparent material and is positioned on the mask by slots that engage with eyelets on the cheek regions of the mask. The head straps of the mask may pass through slots in the eye shield.

U.S. Pat. No. 3,971,368 describes a half mask worn with separate goggles that have their own headband. When in position, the goggles engage an actuating element on the mask and thereby open a valve that directs air from the mask into the goggles.

U.S. Pat. No. 4,172,455 describes an eye-piece that is pivotally mounted on a helmet to which a breathing mask is also connected by adjustable tension straps.

U.S. Pat. No. 5,630,412 describes an eye shield for use with a supplied air half mask, which can be removed while the mask remains in place. To that end, the eye shield has a fixing block that is inserted into a slideway on the mask.

U.S. Pat. No. 5,682,879 describes a 2-panel fold flat particulate mask with a permanently-attached eye shield.

International Application WO 96/34658 describes an eye shield having a body portion that clips over the cap of a centrally-located exhalation valve of a respiratory half mask. Although not described, the eye shield could apparently be removed from the mask while the latter is being worn.

International Application WO 97/04837 describes goggles for use with a face mask, the goggles being detachably-attached to the mask by a tongue-end-groove connection, and held sealingly against the wearer's face by a strap of the face mask.

European Patent 1,086,720 describes a respiratory mask on which a visor is pivotally-mounted so that the position of the visor in the line of sight of the wearer can be adjusted.

It is also known to provide face/eye shields for medical-type particulate masks. Examples of such combinations are described in U.S. Pat. Nos. 5,704,349, 5,446,925, 5,303,423, 5,020,533, and 4,944,294. In each case, the face/eye shield is permanently bonded to the respiratory mask.

SUMMARY OF INVENTION

Although many eye shields have been developed, there remains a need for improved eye-wear that is suitable for use with respiratory masks. The present invention is concerned with the problem of providing an eye-wear article that has a simple construction, that is comparatively easy to manufacture, and that can be specifically adapted to fit a respiratory mask but can easily be removed from the wearer's line of sight, when required, without disturbing the position of the mask on the wearer's face.

The present invention provides an eye-wear article for use with a respiratory mask that has a head harness. In brief summary, the eye-wear article comprises:

a flat piece of transparent polymeric material providing a visor portion, mask-engaging positioning means, and harness-engaging positioning means;

the mask-engaging positioning means and the harness-engaging positioning means being engageable, respectively, with the mask and with the head harness to cause the flat piece of polymeric material to adopt a curved configuration in which, when the mask is being worn, the piece of polymeric material extends from one side of the wearer's face to the other with the visor portion being located in front of the wearer's eyes;

wherein the eye-wear article can be disengaged from the mask and/or the head harness while the mask is being worn, to permit the article to be removed from the line of sight of the wearer without disturbing the position of the mask on the wearer's face and without affecting the respiratory protection provided by the mask.

The term "head harness" means an arrangement that includes at least one headband for fastening the respiratory mask to the wearer's head and that includes the point(s) of attachment of the headband(s) to the respiratory mask (for example, a buckle or guideway through which a headband is threaded and perhaps any associated locking mechanism for preventing the headband from slipping). The term "head harness" also includes, when present, the so-called "cradle" or similar form of support that sits on the crown of the wearer's head.

The present invention also provides an eye-wear article in combination with a respiratory mask that has a head harness. The mask has, on either side of a central portion, guideways that extend from an upper to a lower part of the mask to receive headbands of the head harness.

The eye-wear article comprises:

a flat piece of transparent polymeric material providing a visor portion; and positioning means including elongate tabs that extend from a lower edge of the eye-wear article, each of the tabs being insertable in a respective one of the headband guideways on the mask to locate the visor portion in front of the eyes of the wearer when the mask is being worn;

wherein the tabs can be removed from the guideways while the mask is being worn, to permit the eye-wear article to be removed from the line of sight of the wearer without disturbing the position of the mask on the wearer's face and without affecting the respiratory protection provided by the mask.

When the central portion of the mask comprises a nose bridge, the eye-wear article of this aspect of the invention may comprise a shaped portion formed in a lower edge of the eye-wear article to fit over the nose bridge of the mask.

In this aspect of the invention, location of the eye-wear article on the mask causes the flat piece of polymeric material to adopt a curved configuration in which, when the mask is being worn, the piece of polymeric material extends from one side of the wearer's face to the other with the visor portion being located in front of the wearer's eyes.

In an embodiment of this aspect of the invention, the eye-wear article can be removed completely from the mask without disturbing the position of the mask on the wearer's face.

The present invention further provides an eye-wear article in combination with a respiratory mask that is provided with a head harness, wherein the eye-wear article comprises:

a flat piece of transparent polymeric material forming a visor portion; and positioning means including elongate tabs that extend from each side of the eye-wear article, each of the tabs being insertable in a respective guide on the head harness to locate the visor portion in front of the eyes of the wearer when the mask is being worn;

wherein the tabs can slide in the guides while the mask is being worn, to permit the eye-wear article to be moved out of the line of sight of the wearer without disturbing the position of the mask on the wearer's face and without affecting the respiratory protection provided by the mask.

The eye-wear article of this aspect of the invention may include at least one shaped portion formed in a lower edge of the eye-wear article to fit over a respective selected part of the mask.

In this aspect of the invention, location of the eye-wear article on the mask causes the flat piece of polymeric material to adopt a curved configuration in which, when the mask is being worn, the piece of polymeric material extends from one side of the wearer's face to the other with the visor portion being located in front of the wearer's eyes.

In an embodiment of this aspect of the invention, the eye-wear article can be moved towards the top of the wearer's head and out of the wearer's line of sight without disturbing the position of the mask on the wearer's face. Each of the elongate tabs may be formed with two apertures, engageable with a stop in the respective guide to define, respectively, a position in which the visor portion of the eye-wear article is located in front of the eyes of the wearer, and a position in which the eye-wear article has been moved towards the top of the wearer's head and out of the wearer's line of sight.

BRIEF DESCRIPTION OF THE DRAWINGS

By way of example only, embodiments of the invention will now be described with reference to the accompanying drawings, in which.

DETAILED DESCRIPTION OF PREFERRED EMBODIMENTS

Figure 1:
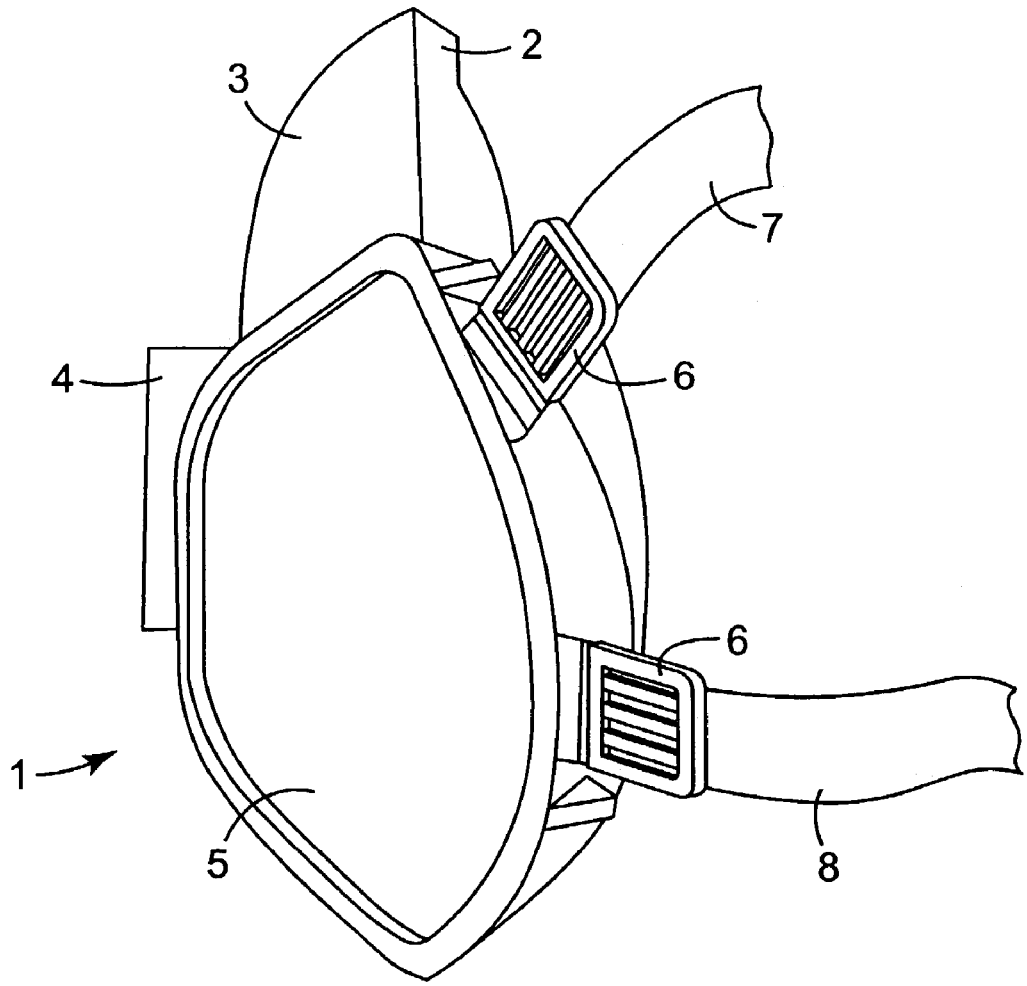
FIG. 1 is a side view of a respiratory half-mask.
Figure 2:
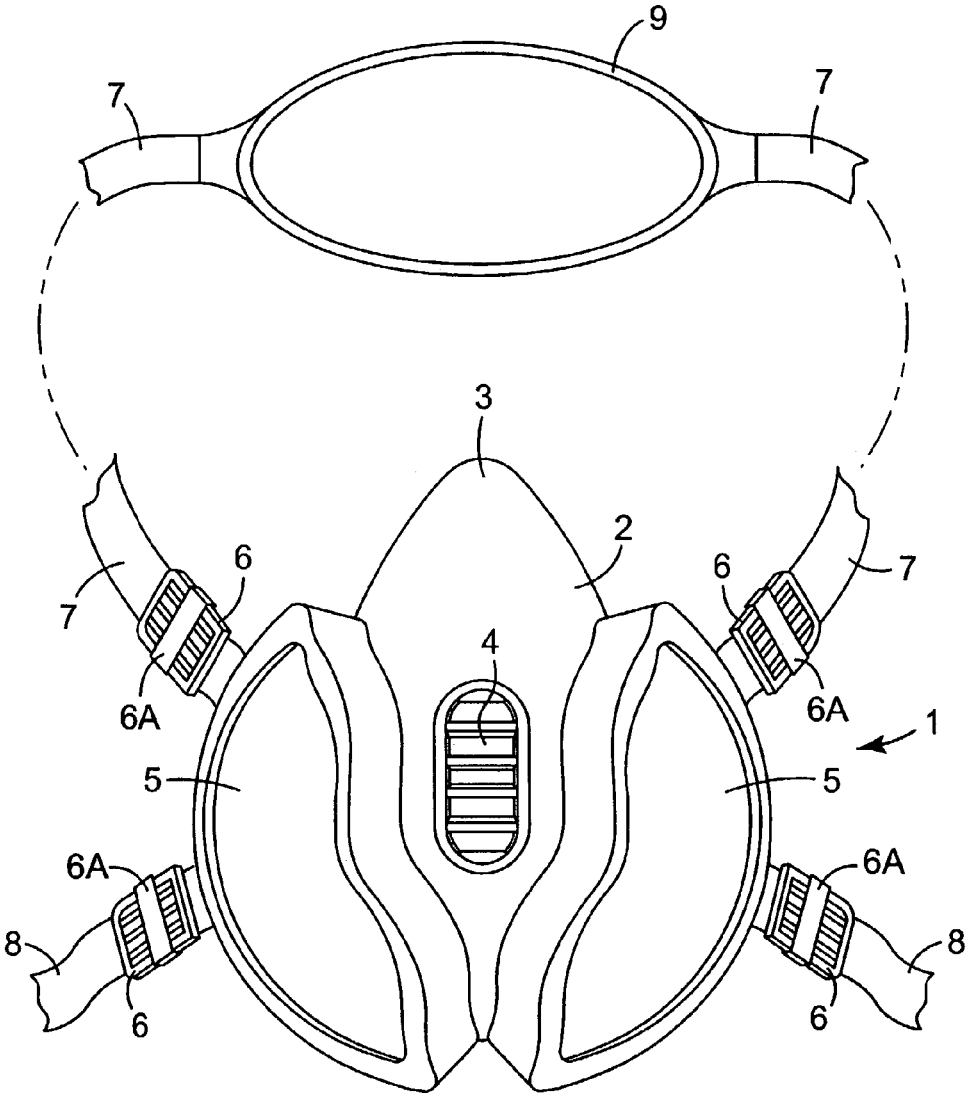
FIG. 2 is a front view of the mask of FIG. 1.

FIGS. 1 and 2 show one form of a respiratory half-mask, that is, a mask that is intended to fit over the nose, mouth and chin of the wearer. The mask 1 comprises a facepiece 2 that is formed from a soft, compliant material (for example, a rubber material) and has an inturned cuff (not visible in the drawings) around its edge. When the mask is being worn, the cuff will form a seal against the wearer's skin. The facepiece 2 has a central portion 3, intended to extend over the bridge of the wearer's nose, in which is mounted an exhalation valve 4. On either side of the exhalation valve 4, the facepiece supports inhalation valves (not visible) over which are mounted filter cartridges 5. At the sides of the facepiece are attachments 6 for upper and lower headbands 7, 8 that form part of a head harness with which the respiratory mask is provided. The attachments 6 can take any suitable form but, as illustrated, comprise buckles through which the headbands are threaded and associated locking rings 6A (shown only in FIG. 2) that function to prevent the headbands from slipping through the buckles once they have been adjusted. The head harness may be of any suitable form and may, for example, include a cradle 9 (shown, diagrammatically and not to scale, in FIG. 2 only) which is intended to sit on the top of the wearer's head, and to which the upper headbands 7 are attached.

The facepiece 2 may be formed by injection moulding, in which case the valve 4, filter cartridges 5 and headband attachments 6 may be moulded in place as the facepiece is being formed.

A respiratory half mask of the type shown in FIGS. 1 and 2 is described in U.S. Pat. No. 4,790,306. In a modified form of the mask, the filter cartridges 5 are attached to the facepiece 2 by bayonet fittings, and can be removed and replaced.

In use, the headbands 7, 8 are adjusted to fit the head of the wearer and to hold the mask 1 against the wearer's face. When the wearer breathes in, air is drawn into the mask 1 through the filter cartridges 5 and the inhalation valves in the cheek portions of the facepiece 2. When the wearer breathes out, air is expelled from the mask through the exhalation valve 4 in the central portion 3.

Many such forms of respiratory half masks are known including, for example, masks available, under the trade designations "4000 Series Respirators" and "6000 Series Respirators" from Minnesota Mining and Manufacturing Company of St. Paul, Minn., U.S.A. Other known forms of respiratory half masks include: fold-flat respiratory masks comprising two or more panels, as described for example in U.S. Pat. Nos. 4,419,994 and 4,600,002 and in International Application WO 96/28217; pre-formed masks of the type described in U.S. Pat. No. 4,883,547; and cup-shaped moulded masks of the type described in U.S. Pat. No. 5,374,458. Various forms of head harness for respiratory masks, and alternative forms of headband attachments are also known (see, for example, WO 01/72156 and WO 99/06116).

Figure 3:
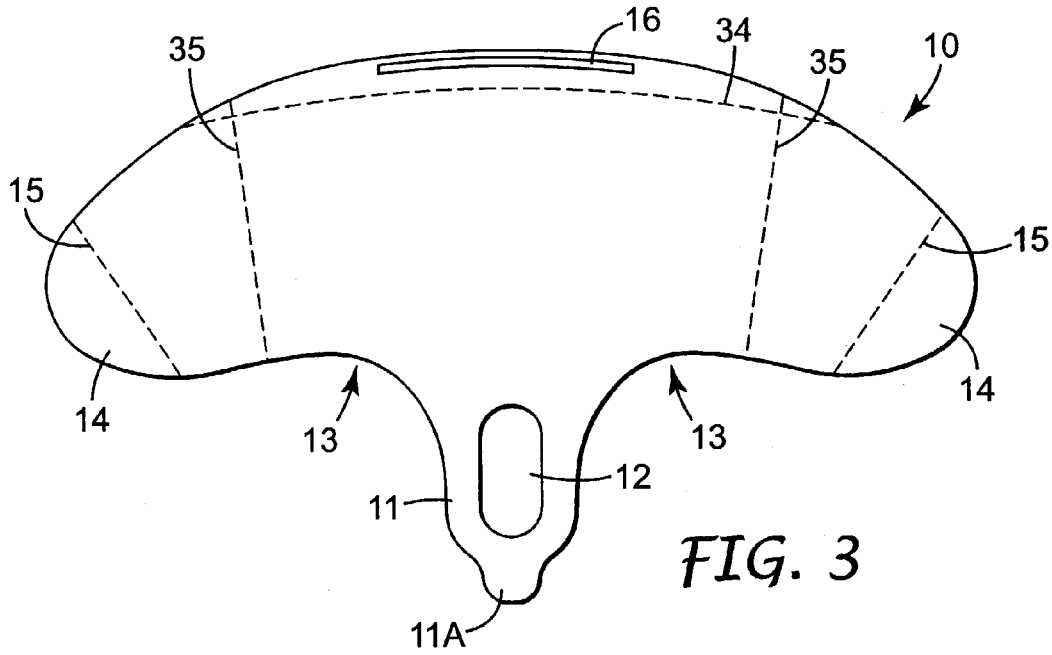
FIG. 3 is a view from the front of an eye-wear article, in accordance with the invention, suitable for use with respiratory masks of the type shown in FIGS. 1 and 2.

FIG. 3 illustrates a first form of eye-wear article 10 that can be used with a respiratory mask 1 of the type shown in FIGS. 1 and 2. The eye-wear article 10 comprises a flat, shaped piece of transparent polymeric material, for example polycarbonate or polyester, and is intended, in use, to extend from the upper part of the mask I as illustrated diagrammatically in FIG. 4. The dimensions of the eye-wear article are such that its central (or visor) portion will then extend over the eye region of the wearer, in both the horizontal and vertical directions. The eye-wear article may be formed by die-cutting from a sheet of suitable material.

As shown in FIG. 3, the lower edge of the eye-wear article 10 has a downwardly-extending central portion 11 containing an aperture 12 that will fit around the exhalation valve 4 of the mask 1 and, on either side of the central portion 11, the lower edge is curved inwardly as indicated at 13 so that it will fit neatly around the top of the two filter cartridges 5 of the mask. The eye-wear article has side-to-side dimensions such that the side portions 14 will extend beyond the respective upper headbands 7, and is provided with fold lines 15 in locations corresponding to the positions of the outer edges of the headbands. The downwardly-extending portion 11 of the eye-wear article, with the aperture 12, comprises a mask-engaging positioning means and the side portions 14 comprise harness-engaging positioning means, the purpose of which will be described below.

Figure 4:
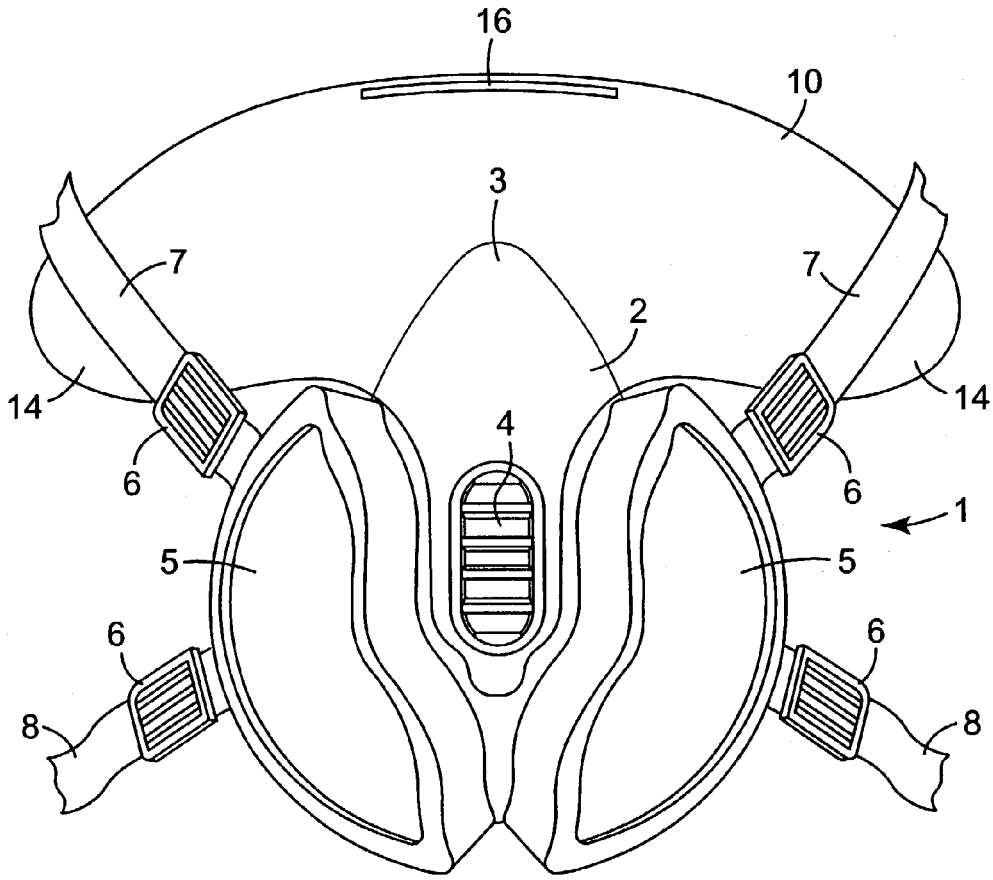
FIG. 4 illustrates the eye-wear article of FIG. 3 in position on the respiratory mask.
Figure 5:
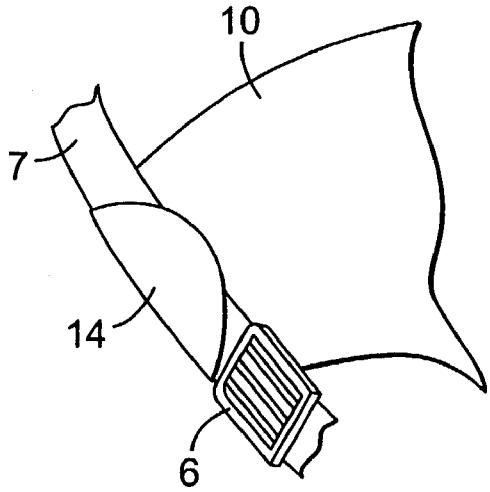
FIG. 5 is an enlarged view of part of FIG. 4, showing the engagement of a side portion of the eye-wear article with a headband of the respiratory mask.

To use the eye-wear article 10, the aperture 12 is positioned over the exhalation valve 4 of the mask 1 and the lower edge of the eye-wear article is positioned along the upper edge of the mask with the inwardly-curved portions 13 located above the filter cartridges 5. The side edges 14 of the eye-wear article are passed behind the upper headbands 7 of the mask as illustrated in FIG. 4 and, if desired, they may then be bent forwards on the fold lines 15 and folded in front of the headbands as shown in FIG. 5. The eye-wear article 10 is thus retained in position in a curved configuration through engagement of the mask-engaging positioning means 11, 12 with the mask at the exhalation valve 4 and engagement of the harness-engaging positioning means 14 with the headband 7. In this position, the eye-wear article will shield the eyes of the wearer against direct splashes of fluid and low-impact foreign bodies without impeding the wearer's vision.

If the wearer wishes to remove the eye-wear article 10 from his line of sight at any time (for example, in the case of a paint sprayer, to inspect the quality of the work that is in progress), it is a comparatively simple matter to disengage it completely from the mask 1 and headbands 7. There are no fasteners to be undone before the eye-wear article can be removed, and the operation can be carried out (often with just one hand) without disturbing the position of the mask on the wearer's face and, consequently, without any loss of respiratory protection. If the eye-wear article is still in a good condition, it can be put back in place; otherwise, it can be discarded and replaced by a new one. In both cases, the eye-wear article can be fitted to the mask while it is being worn, and without disturbing the position of the mask on the wearer's face A further advantage of the eye-wear article 10 shown in FIG. 3 is that, in use, it does not disturb the normal flow of exhaled air from the exhalation valve 4 of the mask 1. Consequently, there is little risk of the warm, moist exhaled air circulating over the eye-wear article and causing misting.

If desired, the eye-wear article 10 may have a strip 16 of foam, or other suitable material, positioned adjacent the upper edge on the inside surface, for increased comfort in the event that the eye-wear article contacts the forehead of the wearer. The length of the foam strip may be varied, depending on the likely extent of that contact.

The fold lines 15 in the eye-wear article of FIG. 3 can be omitted if it is not required to bend the side edges 14 forwards and in front of the headbands 7. In that case, the side edges 14 would be held in place by engagement with the inside surfaces of the headbands.

Figure 6:
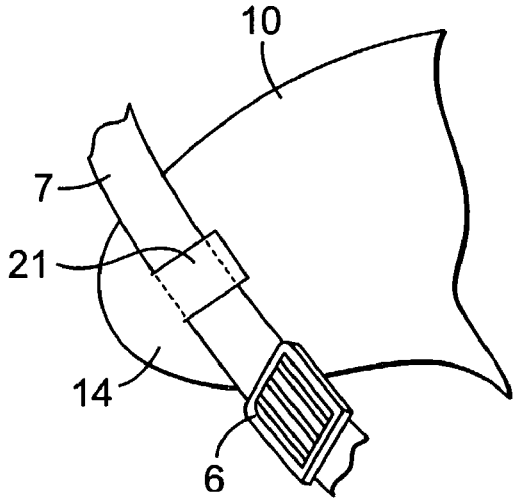
FIGS. 6 to 8 are similar to FIG. 5 and illustrate modifications to the eye-wear article of FIG. 3.
Figure 7:
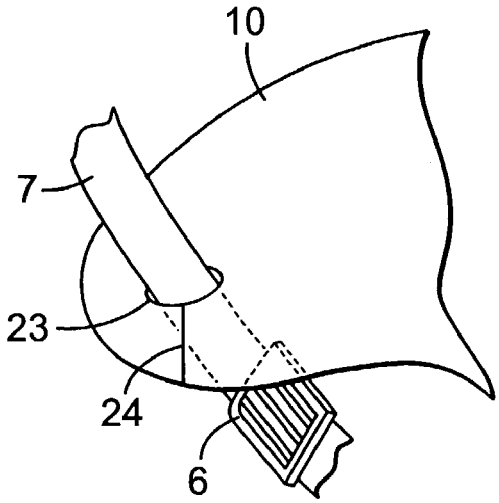
Figure 8:
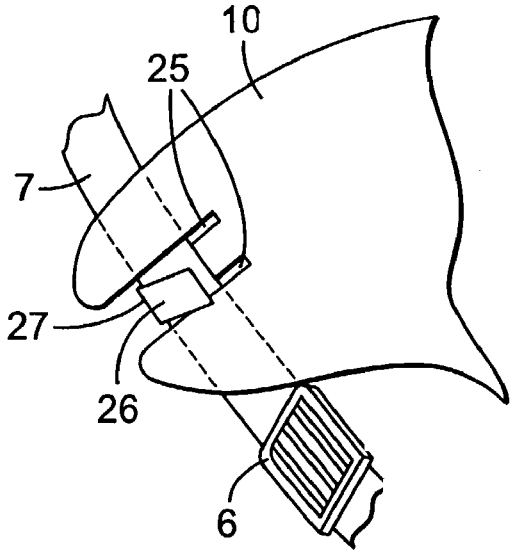

Some possible modifications to the side edges 14 of the eye-wear article 10, providing alternative positioning means for engaging the upper headbands 7, are illustrated in FIGS. 6 to 8.

The modification illustrated in FIG. 6 comprises replacing each fold line 15 of FIG. 3 by slots forming a rectangular tab 21 in each side portion 14 of the eye-wear article. The headband 7 on each side of the mask 1 can then be tucked behind the respective tab 21 and held between the tab and the side portion 14 of the eye-wear article as shown.

Alternatively, each side portion 14 of the eye-wear article 10 may be provided with an aperture 23 into which the upper headband 7 of the mask can be guided by means of a slot 24 leading from the aperture to the edge of the eye-wear article, as illustrated in FIG. 7. The slot 24 need not be straight: it could instead follow a convoluted path of any suitable shape and extending in any suitable direction to reduce the risk of the eye-wear article being detached inadvertently from the mask headband 7.

In yet another modification, illustrated in FIG. 8, two parallel slots 25 are cut into the side edge of the eye-wear article 10, forming a rectangular tab 26. The tab 26 is additionally provided with a transverse fold line 27 at a point about halfway along its length. In this case, the headband 7 lies on one side of the eye-wear article 10 (the rear side, as shown in FIG. 8), and passes over the other side of the tab 26 which is then bent around the headband on the fold line 27.

Figure 9:
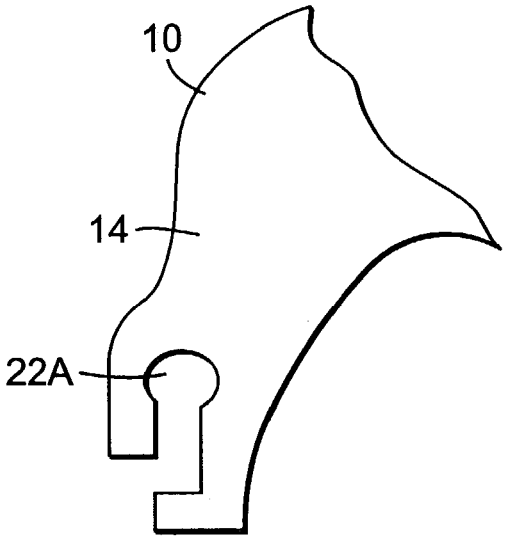
FIG. 9 is a front view of another eye-wear article, in accordance with the invention.
Figure 10:
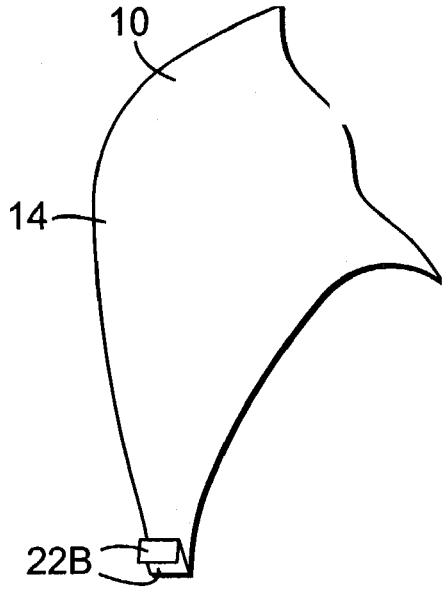
FIGS. 10 to 12 are similar to FIG. 5, but with the headband omitted, and illustrate further modifications to the eye-wear article of FIG. 3.

FIGS. 9 and 10 illustrate alternative forms for the side portions 14 of the eye-wear article 10, in both of which the side portions are extended in a downwards direction to engage the lower headband 8 or associated buckles of the mask head harness (see FIGS. 1 and 2) instead of the upper headband 7. In FIG. 9, the lower end of an extended side portion 14 is shown with a keyhole-shaped cut-out 22A for engagement with the lower headband 8 or associated buckle and, in FIG. 10, it is shown with fold lines 22B enabling it to be wrapped around the lower headband or associated buckle.

Figure 11:
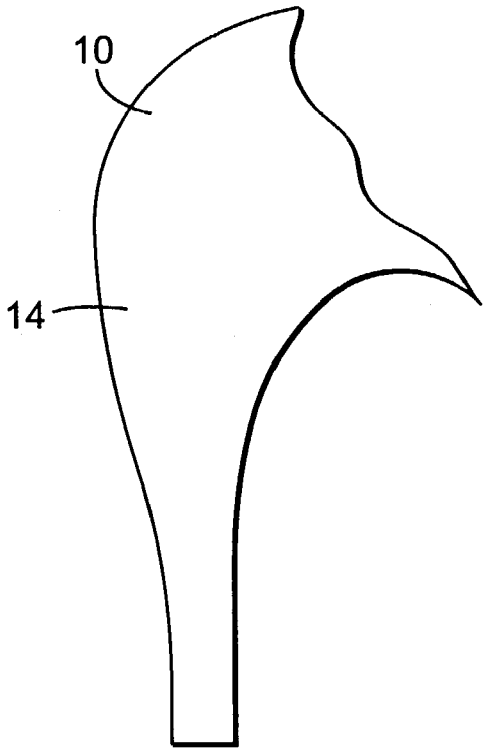

FIG. 11 illustrates yet another modification of the eye-wear article 10, in which each side portion 14 is extended in a downwards direction so that it can be tucked behind, and held in place by, both the upper and lower headbands 7, 8 of the mask head harness.

It will be appreciated that the modifications illustrated in FIGS. 6 to 11 all allow the eye-wear article 10 to function in the manner similar to that described above with reference to FIGS. 3 to 5. Other alternative positioning means are available for engaging the sides 14 of the eye-wear article with the head harness of the mask and include, for example, the use of some form of releasable mechanical fastener such as a press stud or a separate push-on clip. The mechanical fasteners could be used to engage the sides 14 of the eye-wear article with the headbands 7 or the headband attachment points 6, (including the locking rings 6A) or with any other suitable part of the head harness.

Figure 12:
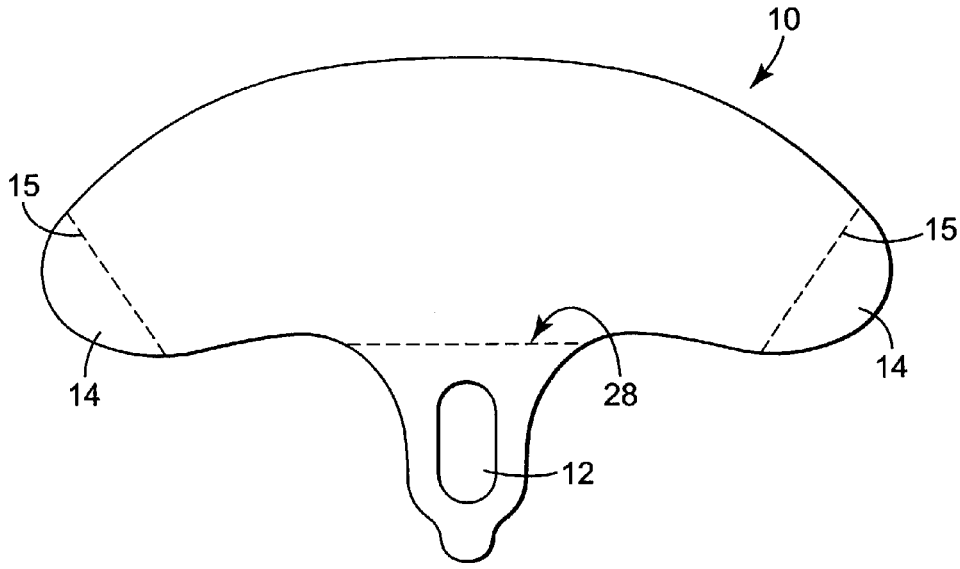

FIG. 12 illustrates a further modification that allows the eye-wear article 10 of FIG. 3 to be disengaged from the headbands 7 and removed from the line of sight of the wearer without being disengaged from the respiratory mask 1. The modification comprises the formation of a hinge line 28 across the top of the downwardly-extending central portion 11 of the eye-wear article 10, above the aperture 12. This hinge line 28 allows the eye-wear article to be removed from the line of sight of the wearer simply by being pivoted forwards (the side edges 14 having been previously disengaged from the mask headbands 7). The eye-wear article 10 remains engaged with the exhalation valve 4 of the mask, and can be restored to the upright position and re-engaged with the mask headbands 7 when required. The eye-wear article can, of course, also be removed completely from the mask as described above when it needs to be replaced.

Although FIG. 12 shows the hinge line 28 provided in an eye-wear article of the type shown in FIG. 3, it could similarly be provided in any of the modified eye-wear articles described above with reference to FIGS. 6 to 11.

Figure 13:
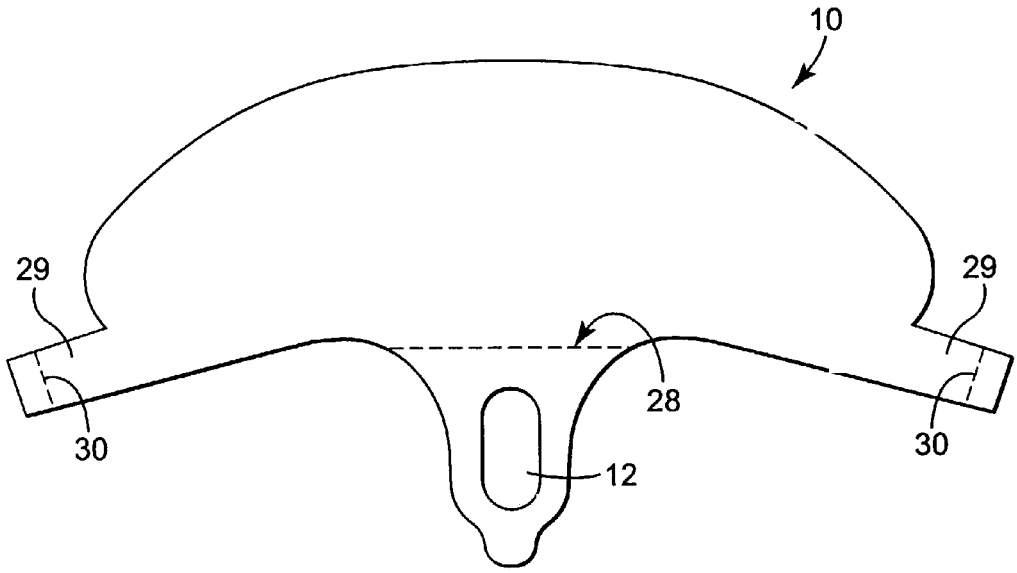
FIGS. 13 to 15 are front views of other eye-wear articles in accordance with the invention.

By modifying the side edges 14 of the eye-wear article of FIG. 12 to include elongated tabs 29 with fold lines 30, as illustrated in FIG. 13, for engaging the mask headbands 7, the main part of the eye-wear article can be caused to incline slightly forwards in use, about the hinge line 28. As a consequence, the eye-wear article will sit slightly further away from the wearer's face and will allow the use of spectacles.

Figure 14:
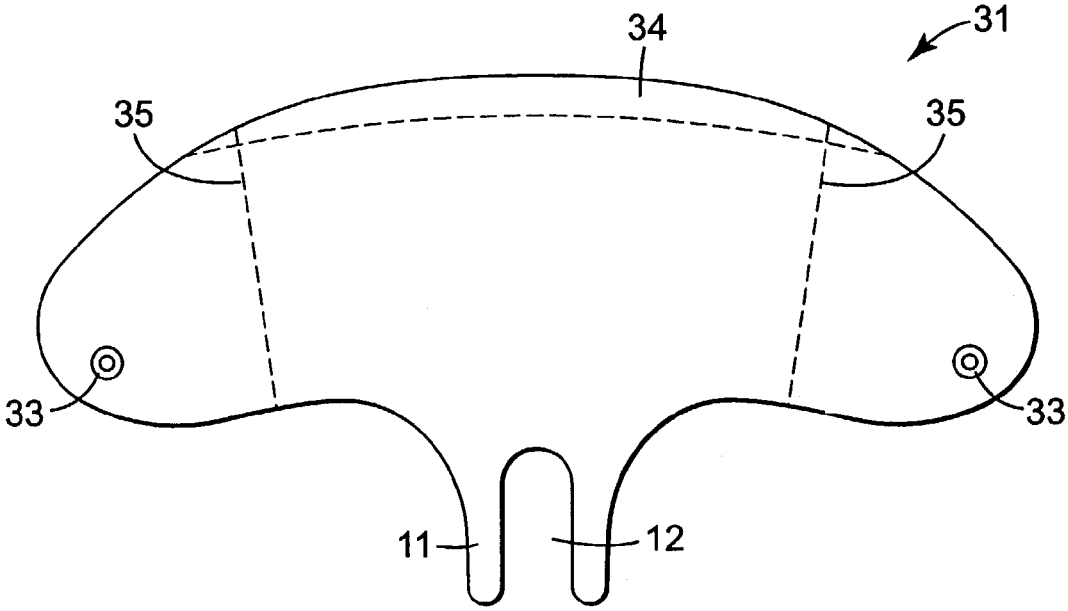

Another eye-wear article 31, also suitable for use with the respiratory mask 1 of FIGS. 1 and 2, is shown in FIG. 14. This eye-wear article is of similar shape to that of FIG. 3, but is intended to be attached to the head harness of the mask by two releasable mechanical fasteners, for example press studs, one part (33) of each of which is mounted on a respective side of the eye-wear article. The other parts (not shown) of the mechanical fasteners are mounted on suitable attachment points on the head harness for example on the headbands 7 or at the attachment points 6 (for example, on the buckle locking rings 6A). The downwardly-extending central portion 11 of the eye-wear article is also modified in that the aperture 12 is open at its lower end so that the central portion effectively has the form of a two-pronged fork. In this form, the central portion 11 of the eye-wear article 31 does not need to be located over the exhalation valve 4 but can alternatively be slid onto the valve from above. A similar modification could be made to any of the eye-wear articles of FIGS. 3 to 13: alternatively, the central portion 11 of the eye-wear article 31 could be shaped in a similar fashion to that of FIG. 3.

It will be appreciated that each of the eye-wear articles described above with reference to FIGS. 3 to 14, although formed from a flat piece of sheet material, adopts a curved form across the eye region of the wearer when in position on the mask 1 as a result of its engagement with the latter. If desired, the eye-wear article can be forced to adopt a curved form before it is positioned on the mask by folding the curved upper edge of the sheet material forwards and downwards about a line 34 (see FIGS. 3 and 14) across the top of the eye-wear article. In that case, the foam strip 16 could be omitted or re-positioned. Vertical hinge lines, such as those indicated at 35 in FIGS. 3 and 14, can be formed in the sheet material to assist the curvature if desired. Alternatively, the flat piece of polymeric material can be provided with a frame formed from a material (for example, extruded aluminium) that can be bent to provide the eye-wear article with the required degree of curvature: the frame can extend along substantially the whole periphery of the eye-wear article but should extend along only the upper edge if the eye-wear article is required to fold forwards as described above with reference to FIG. 12.

The aperture 12 of the eye-wear articles 10, 31 can be provided with a foam or rubber rim to improve the engagement of the eye-wear article with the exhalation valve 4 of the respiratory mask. In some cases, it may be desirable to turn the rim of the aperture 12 inwards (i.e. so that it extends towards the facepiece 2 of the mask, when positioned on the exhalation valve). The rim will then prevent the eye-wear article from being pushed too far onto the exhalation valve and will serve to ensure that a certain minimum spacing exists between the eye-wear article and the face of the wearer. The minimum spacing may, for example, be sufficient to enable spectacles to be worn behind the eye-wear article.

Figure 15:
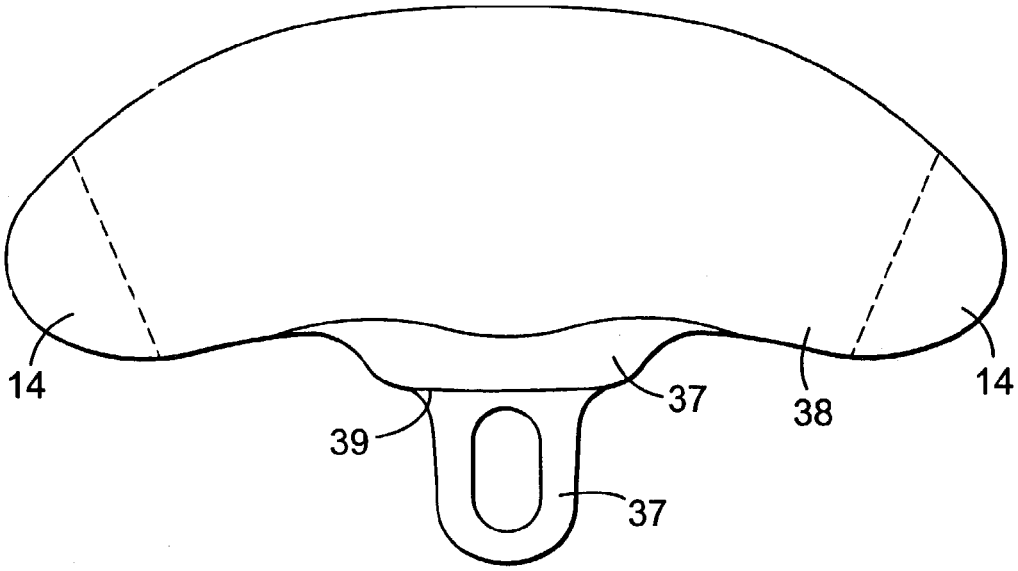

As a further alternative, the downwardly-extending portion 11 only of the eye-wear articles 10 can be formed from a material that can be stretched over the exhalation valve 4 of the respiratory mask, thereby permitting a more secure fit onto the mask. At the same time, the junction between the portion 11 and the remainder of the mask will form a hinge about which the eye-wear article can be folded forwards, in a similar manner to that shown in FIG. 12. It is also possible for the downwardly-extending portion 11 and a lower part of the main portion of the eye-wear article to be formed as a separate moulded component 37 (see FIG. 15) to which a flat piece of transparent polymeric material 38 (providing the visor portion of the eye-wear article) is attached. A hinge 39 is formed in the moulded component 37 to permit the portion 38 of the eye-protector to be folded forwards as described with reference to FIG. 12. The side portions 14 of the eye-wear article can be engaged with the head harness of the respiratory mask in any of the ways described above with reference to FIGS. 3 to 14.

Each of the eye-wear articles 10 described above can be provided with a tab 11A at the lower end of the downwardly-extending portion 11 (see FIG. 3) to assist in removing the eye-wear article 10 from the respiratory mask. The tab 11A may be an integral part of the eye-wear article, as in FIG. 3, but it could be formed from a softer material as a separate item and then secured to the eye-wear article.

The aperture 12 of the eye-wear article 10 of FIG. 3 is described above as being a close fit on the exhalation valve 4 of the respiratory mask 1. As an alternative, the aperture 12 can be larger than the exhalation valve (thereby avoiding the need to dimension the aperture accurately), with the eye-wear article then being provided with some mechanism for holding it in place on the exhalation valve structure. For example, an elastic cord can be secured in the downwardly-extending portion 11 so that it extends horizontally across the middle of the aperture 12 from one side to the other and, in use, can be stretched around the bottom of the exhalation valve 4. Alternatively, the downwardly-extending portion 11 of the eye-wear article 10 can be formed with a horizontally-extending curve that opens out to allow the aperture 12 to slip over the exhalation valve 4 and then reverts to its original form to bring the upper and lower end of the aperture 12 into positive engagement with the upper and lower ends of the exhalation valve structure.

To enable any of the eye-wear articles 10, 31 described above to be used with a respiratory mask having an alternative form of exhalation valve, a separate adapter can be fitted to the exhalation valve to provide the valve structure with the appropriate shape. The adapter could, for example, be a push-fit onto the exhalation valve. One form of adapter is shown in FIGS. 16 and 17, and another in FIG. 18.

Figure 16:
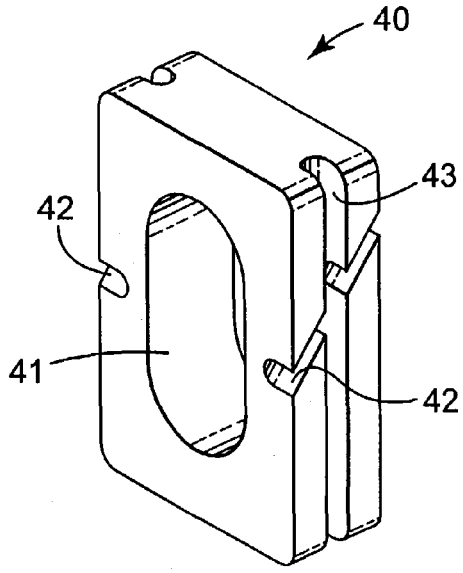
FIGS. 16 and 17 are, respectively, a perspective view from the front and a side view of an adapter for use with an eye-wear article in accordance with the invention.
Figure 17:
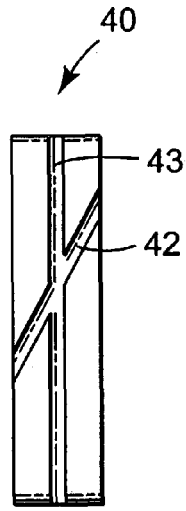

The adapter 40 shown in FIGS. 16 and 17 is intended for use with an eye-wear article 31 having a forked extension 11 of the type shown in FIG. 14. The adaptor 40 comprises a block of polymeric material having a central aperture 41 that enables the adapter to be a push-fit onto the exhalation valve of the respiratory mask. Pairs of grooves 42, 43 are formed in the sides of the adaptor, into which the forked extension 11 of the eye-wear article 31 can be slid to position the eye-wear article at a pre-selected angle to the face of the wearer of the respiratory mask. In the adaptor 40, there is a first pair of grooves 42 that provides a rearwardly-inclined position for the eye-wear article and a second pair of grooves 43 that provides a vertical position: however, the number and location of the grooves could be varied. In an alternative construction, the grooves 42, 43 are formed in a hinged upper extension of the adapter, enabling the eye-protector to be folded forwards as described with reference to FIG. 15. It will be appreciated that an adapter of the type shown in FIGS. 16 and 17 could also be used with an eye-wear article 10 having an apertured extension 11 of the type shown in FIG. 3 but, in that case, the adapter block would be formed with an external shape corresponding to that of the aperture 12 in the eye-wear article.

Figure 18:
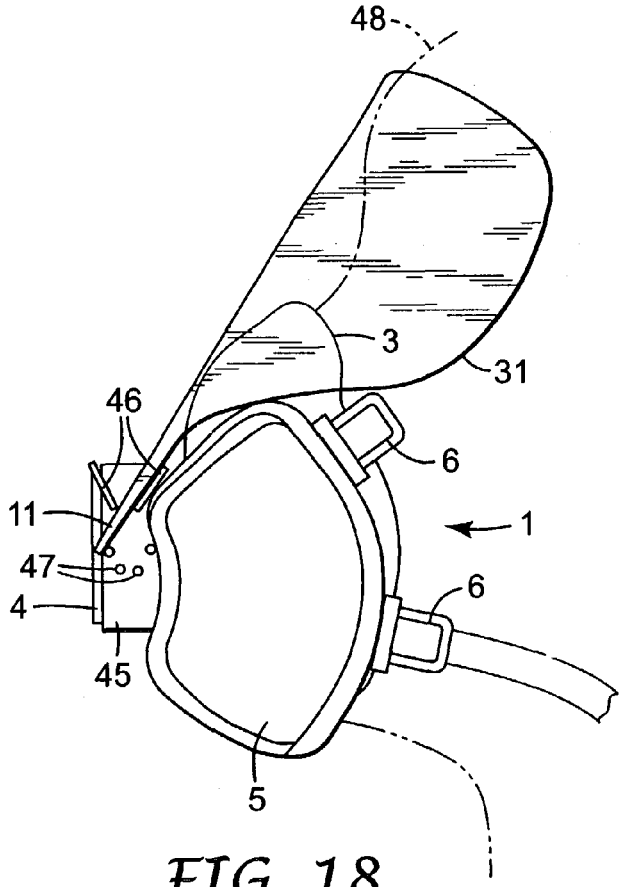
FIG. 18 is a side view of an eye-wear article positioned on an adapter that forms part of the exhalation valve structure of a respiratory mask.

In the adapter 45 shown in FIG. 18, the inclined grooves 42 of the adapter 40 are replaced by inclined guide surfaces 46 and associated stops 47 formed in the sides of the adapter block. This adapter is also intended for use with an eye-wear article 31 having a forked extension 11 of the type shown in FIG. 14, but offers alternative positions for the eye-wear article relative to the face of the wearer of the respiratory mask. FIG. 18 shows the adapter 45 located on the exhalation valve 4 of a respiratory mask 1, with the forked extension 11 of eye-wear article 31 having been slid into a position in which it lies very close to the face of the wearer (indicated by the dotted line 48). However, by selecting the alternative guide surface 46 and/or alternative stops 47, the eye-wear article 31 can be positioned further away from the wearer's face 48, for example to accommodate spectacles.

When used with an adaptor of the type shown in FIGS. 16 and 17, or of the type shown in FIG. 18, the side portions of the eye-wear article are releasably engaged in any suitable way with the head harness of the respirator mask.

The adaptor of FIG. 18 can be modified to provide pivot points, one on each side of the exhalation valve structure, to which the lower-ends of the forked extension 11 of the eye-wear article 31 can be releasably attached. An arrangement of that type can permit the eye-wear article to be pivoted forwards, after the side portions 14 have been disengaged from the head harness of the respiratory mask, until it hangs downwards in front of the respiratory mask. Stops can be provided in the sides of the adaptor to define the end positions of the eye-wear article and ensure that it is retained in one or other of those positions as required.

Figure 19:
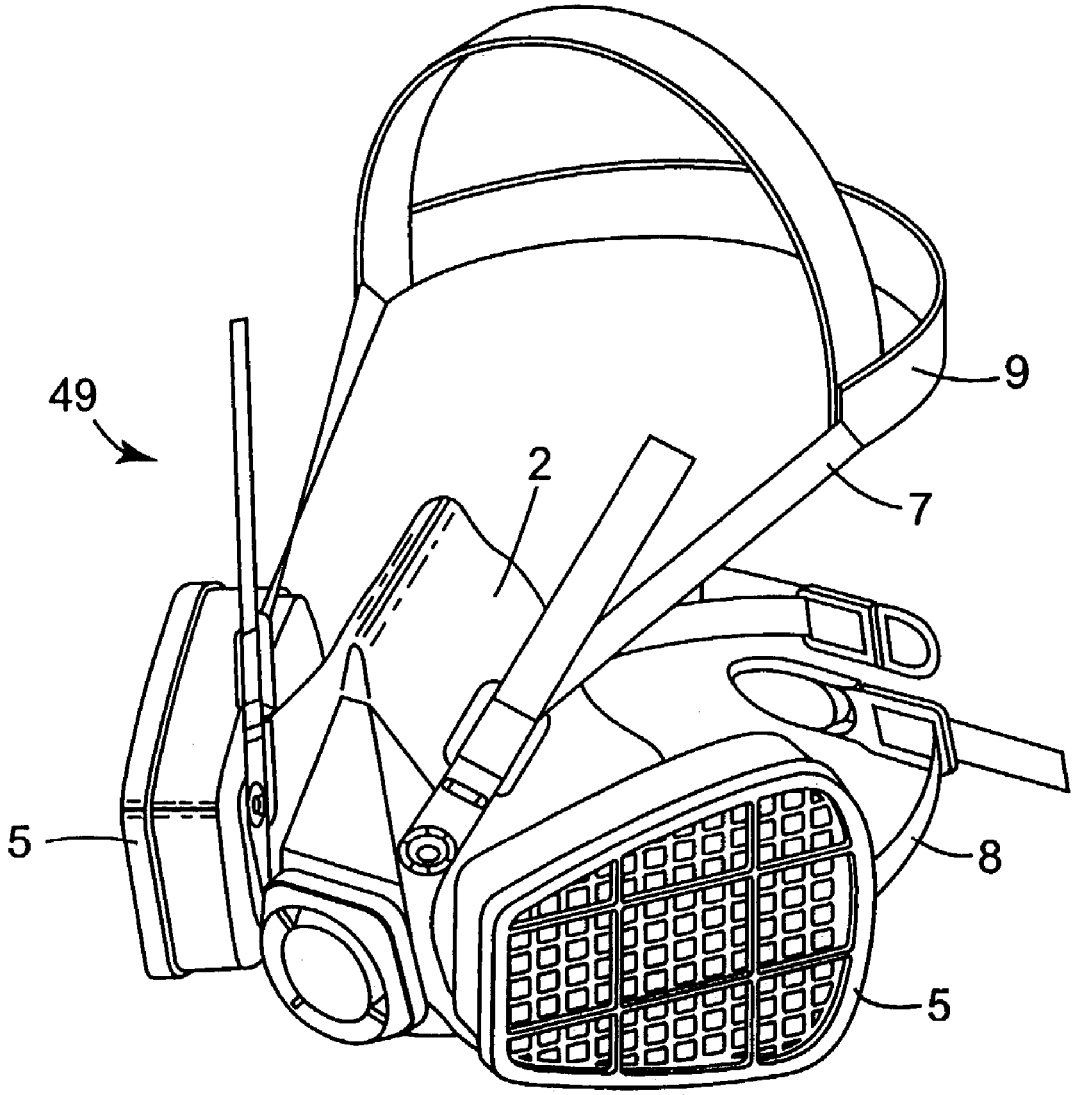
FIG. 19 is a perspective view of another respiratory mask.

FIG. 19 shows a respiratory mask 49 that is similar to the mask 1 shown in FIGS. 1 and 2 except that the filter cartridges 5 are releasably attached to the mask by bayonet fittings. The bayonet fittings are not visible in FIG. 19 but are indicated at 5A in FIG. 20, which shows the mask 49 with the filter cartridges 5 temporarily removed and fitted with an alternative form of eye-wear article 50. The eye-wear article 50 has mask-engaging positioning means in the form of supports 51 that engage the mask at the bayonet fittings 5A as described below. The visor portion 52 of the eye-wear article 50 is provided by a flat piece of transparent polymeric material, the upper edge of which is pivotally-connected at 51A to the upper ends of the supports 51 (as described in greater detail below with reference to FIG. 21). The lower ends of the supports 51 carry apertured discs 53 that can be pushed over the bayonet fittings 5A on the respiratory mask 49 before the filter cartridges 5 are attached, and will then be held in place by the latter. When the respiratory mask is in use, the portion 52 of the eye-wear article is located in front of the supports 51 and is suspended, by the latter, in front of the eyes of the wearer where it adopts a curved configuration across the wearer's face when the side portions 14 (functioning as harness-engaging positioning means) are located behind the upper head bands (not shown) of the mask, as described above for the eye-wear article 10 of FIG. 4. When required, the portion 52 of the eye-wear article can be removed from the line of sight of the wearer by disengaging the side portions 14 from the headbands and pivoting the portion 52 upwards about the connections 51A onto the top of the wearer's head.

Figure 20:
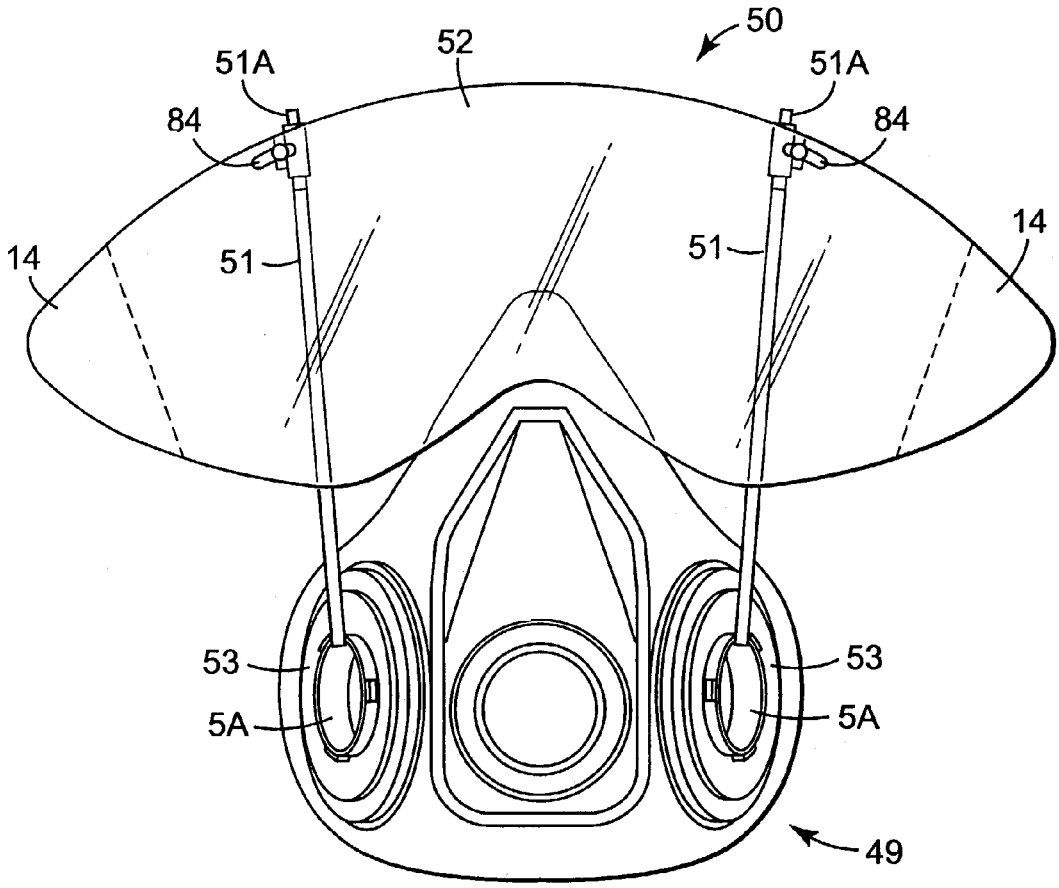
FIG. 20 is a front view of another eye-wear article in position on the respiratory mask of FIG. 19, from which the filters have been removed.
Figure 21:
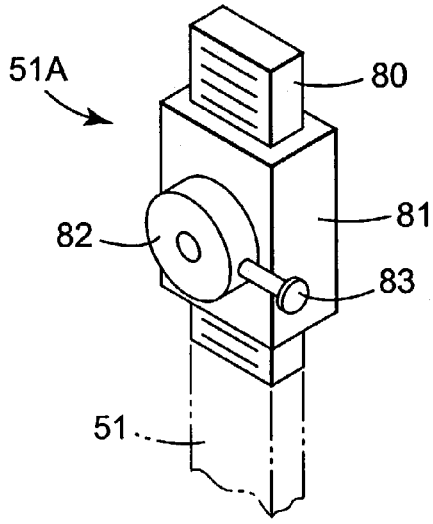
FIG. 21 is an enlarged perspective view of part of a support of the eye-wear article of FIG. 19.

FIG. 21 illustrates, in greater detail on an enlarged scale, the components of the connection 51A between the visor portion 52 and one of the supports 51 of FIG. 20. The connection advantageously also permits the vertical position of the visor portion 52, relative to the respiratory mask 49, to be adjusted. The upper end of the support 51 carries a rack 80 that is surrounded and engaged by a sleeve 81 on which a wheel 82 is rotatably mounted. A post 83 with an enlarged head extends radially from the wheel 82 and, in use, is engaged in a slot 84 (see FIG. 20) adjacent the upper edge of the visor portion 52. The wheel 82 permits the visor portion 52 to be pivoted upwards to remove it from the line of sight of the wearer, and the rack mechanism 80, 81 permits the vertical position of the wheel on the support 51 to be adjusted.

It will be appreciated that the eye-wear article 50 of FIG. 20 engages with the filter fittings of a respirator rather than with the exhalation valve structure. The use of the supports 51 in the eye-wear article, to enable it to be supported from the filter fittings, is not essential although the supports as described do allow the vertical position of the visor portion 52, relative to the respiratory mask, to be adjusted. Depending on the form of the respiratory mask, the eye-wear article could alternatively be provided with two downwardly-extending forked portions (similar to the portion 11 in the eye-wear article of FIG. 14) that could engage with the filter fittings of the mask instead of the supports 51.

Figure 22:
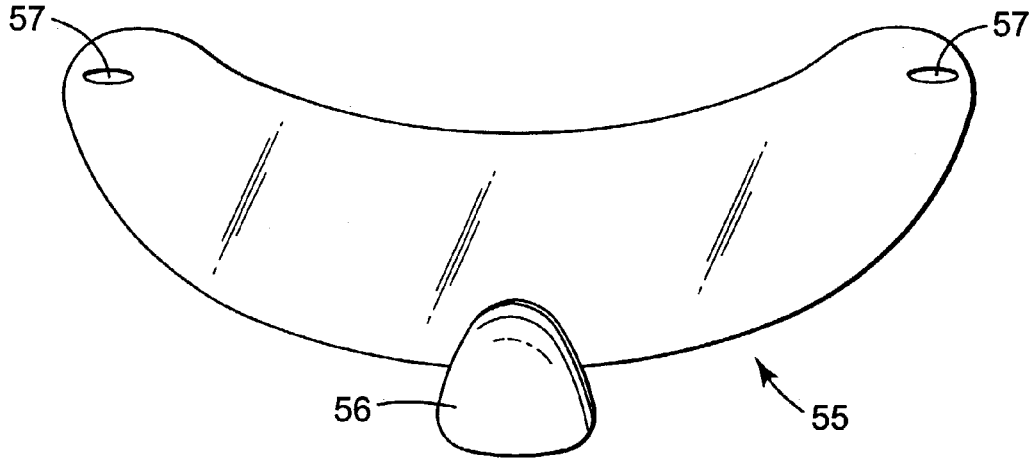
FIGS. 22 and 23 are front views of other eye-wear articles, in accordance with the invention.

FIG. 22 illustrates an alternative eye-wear article 55 suitable for use with a respiratory mask 1 of the type shown in FIGS. 1 and 2 or FIG. 19, and with other respiratory half masks having a nose bridge portion 3. In this case, the eye-wear article is intended to remain in engagement with the respirator headbands 7 when temporarily removed from the line of sight of the wearer.

The eye-wear article 55 comprises a flat sheet of any suitable transparent polymeric material, for example polycarbonate or polyester. The eye-wear article is dimensioned to extend over the top of the respiratory mask from one side to the other of the eye region of the wearer, and has a nose piece 56 that will sit on the nose bridge region of the central portion 3 of the mask. In use, the respirator upper headbands 7 are threaded through slots 57 in the side edges of the eye-wear article. The nose piece 56 and the slots 57 thus function, respectively, as mask-engaging and harness-engaging positioning means to locate the eye-wear article in front of the eyes of the mask wearer.

If the wearer wishes to remove the eye-wear article 55 from his line of sight at any time, it can simply be slid upwards on the headbands 7 to rest on the top of the wearer's head where it can remain until further required, when it can be returned to its original position. The respiratory protection provided by the mask is unaffected by this change in the position of the eye-wear article 55.

Figure 23:
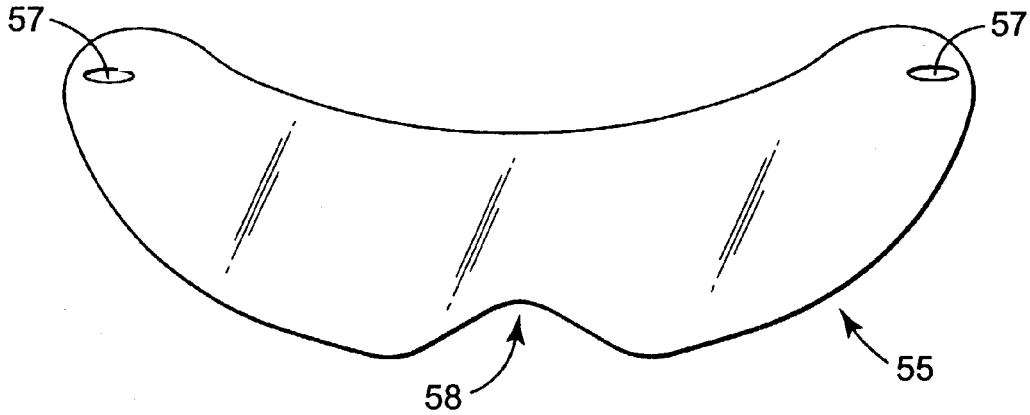

The nose piece 56 can be omitted, in which case the lower edge 58 of the eye-wear article 50 is curved inwardly at the centre as shown at in FIG. 23 so that it will locate on the nose bridge of the respiratory mask 1. When the nose piece 56 is present, it need not be formed from the same material as the remainder of the eye-wear article: it could, for example, be formed from a material that will form a more positive engagement with the nose bridge of the respiratory mask.

In some cases, it may additionally be desirable to be able to remove the eye-wear article 55 completely from the mask 1 so that it can be discarded if it becomes marked or damaged. One way in which that can be achieved is by providing slits (not shown) extending from the slots 57 to the edge of the eye-wear article 55 so that the eye-wear article can be disengaged from the headbands 7. Alternatively, the eye-wear article 55 can be provided with sliding connectors of the type illustrated in FIG. 24 or FIG. 25, for use in connecting it to the headbands 7.

Figure 24:
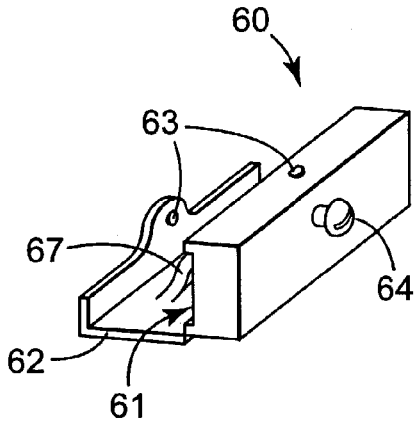
FIGS. 24 and 25 show two forms of sliding connector for attaching the eye-wear articles of FIGS. 22 and 23 to the headbands of a respiratory mask.

The slide connector 60 shown in FIG. 24 is a clip of generally rectangular form and, in use, is fitted around one of the upper headbands 7 of the respiratory mask so that it can move backwards and forwards along the headband between the attachment point 6 and the cradle 9 (see FIG. 2). To that end, the clip contains an open-ended passageway 61 in which the headband 7 is located and has a cover 62, hinged to the remainder of the clip, that can be opened as shown in FIG. 23 to provided access to the passageway. When the headband has been located in the passageway, the cover 62 is closed and held by a clip fastener 63. The rear surface of the clip 60 carries a stud 64 that can be inserted into the slot 57 in the adjacent side edge of the eye-wear article 55 and thus attach the latter to the headband. The head of the stud 64 is flattened on two sides to enable it to be inserted into the slot, the clip thereafter being rotated into alignment with the normal position of the headband 7. A second clip is used to attach the other side of the eye-wear article 55 to the upper headband 7 on the other side of the respiratory mask. The eye-wear article 55 can now be slid up and down on the headbands 7 and pivoted relative to the connectors 60 as required to enable it to be pushed onto the top of the wearer's head but can also be removed completely, either by disengaging the studs 64 of the clips 60 from the eye-wear article or by opening the clips 60 and removing them from the headbands.

Figure 25:
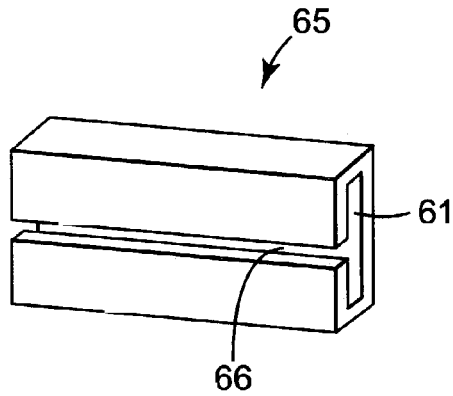

The slide connector 65 shown in FIG. 25 functions in a similar manner to the clip 60 but is in the form of a slotted sleeve. In this case, the access to the passageway 61 for the headband is through an opening slot 66 in one face of the sleeve. The opposite face of the sleeve (not visible in FIG. 24) carries the stud 64 that is used to attach the sleeve to the eye-wear article.

The clip 60 and sleeve 65 both enable the eye-wear article to be slid upwards on the headbands 7 onto the top of the wearer's head without increasing the tension on the headband and with no effect on the comfort of the respiratory mask. To reduce the risk of undesirable movement of the eye-wear article when in the raised position, each of the passageways 61 may have an undulating section (indicated at 67 in FIG. 24) that will function to hold the clip 60 or sleeve 65 in any selected position on the headband 7 while still allowing it to be slid backwards and forwards.

Figure 26:
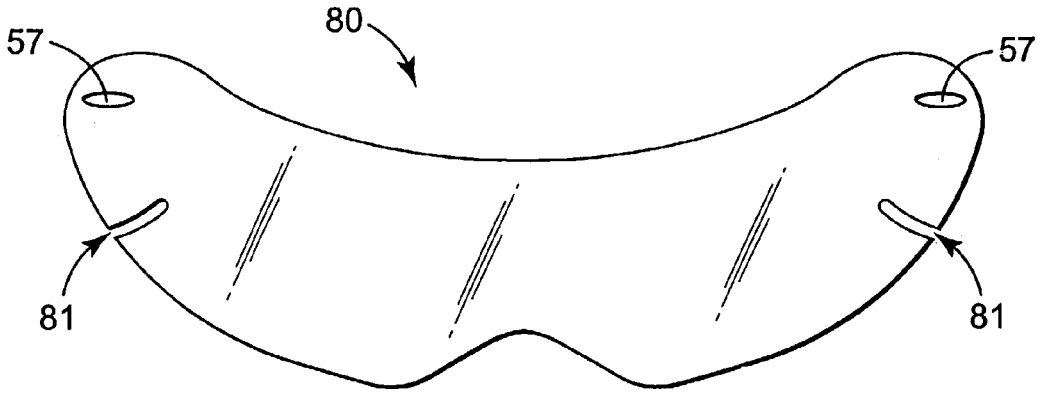
FIGS. 26 and 27 are, respectively, a front view of another eye-wear article in accordance with the invention and a perspective view of a sliding connector for attaching the eye-wear article to the headbands of a respiratory mask.
Figure 27:
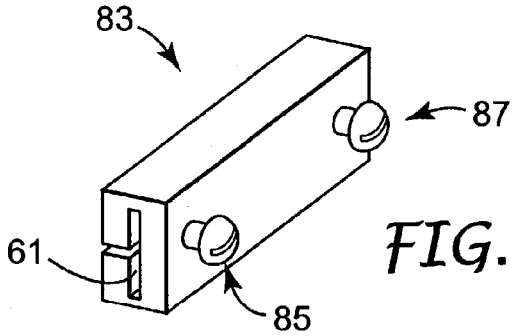

FIG. 26 shows an eye-wear article 80 that is similar to the eye-wear article of FIG. 23 but is provided with a slot 81 in each side edge, below the respective aperture 57. The slots 81 enable a modified sliding connector 83, illustrated in FIG. 27, to be used to connect the eye-wear article 80 to the upper headbands 7 of a respiratory mask. The connector 83 is similar to that shown in FIG. 25, described above, but is provided on its rear surface with two studs 85, 87 rather than a single stud as in FIG. 24. Two such connectors are used, one on each side of the eye-wear article 80 and, in each case, one of the connector studs 85 is located in the slot 57 in the eye-wear article, and the respirator headband 7 is located in the connector passageway 61 as described above with reference to FIG. 25. The connectors 83 will then function as described above to allow the eye-wear article to be slid upwards on the headbands 7 onto the top of the wearer's head. When the eye-wear article is in use (i.e. in the lowered position in which it rests on the nose bridge of the respiratory mask), the second stud 87 of each connector 83 is located in the respective slot 81 in the eye-wear article and restricts the pivotal movement of the eye-wear article relative to the connectors 83, thus providing additional stability to the eye-wear article when in this position.

Figure 28:
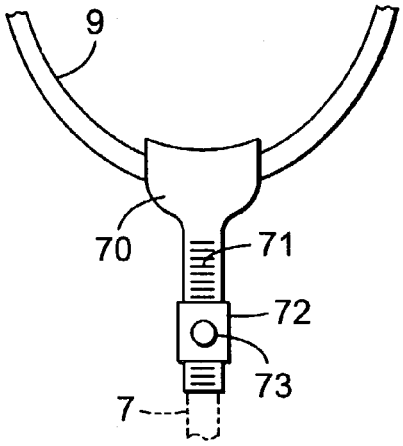
FIGS. 28 and 29 illustrate a clip that can be used instead of the sliding connectors of FIGS. 24 and 25 to attach an eye-wear article to the headbands of a respiratory mask.

As an alternative to the use of the slide connectors 60, 65 on the headbands 7, the eye-wear articles 55 of FIGS. 22 and 23 could be pivotally-connected via clips to the cradle 9 of the head harness. FIG. 28, for example, shows one side of the cradle 9 and its attachment to the headband 7 and also shows an elongated clip 70 (see also FIG. 29) hung from the cradle so that it overlies the upper portion of the headband. A rack 71 is formed on the portion of the clip 70 that overlies the headband and carries a slide 72 with a stud 73 that can be inserted into the respective slot 57 in the eye-wear article 55. This arrangement enables the eye-wear article 55 to pivot relative to the cradle 9 on the studs 73 and to be moved vertically relative to the cradle by pushing the slide 72 up and down on the rack 71. If it is required to remove the eye-wear article 55 completely from the respiratory mask, that can be achieved either by disengaging the eye-wear article from the studs 73 or by unhooking the clip 70 from the cradle 9.

Figure 30:
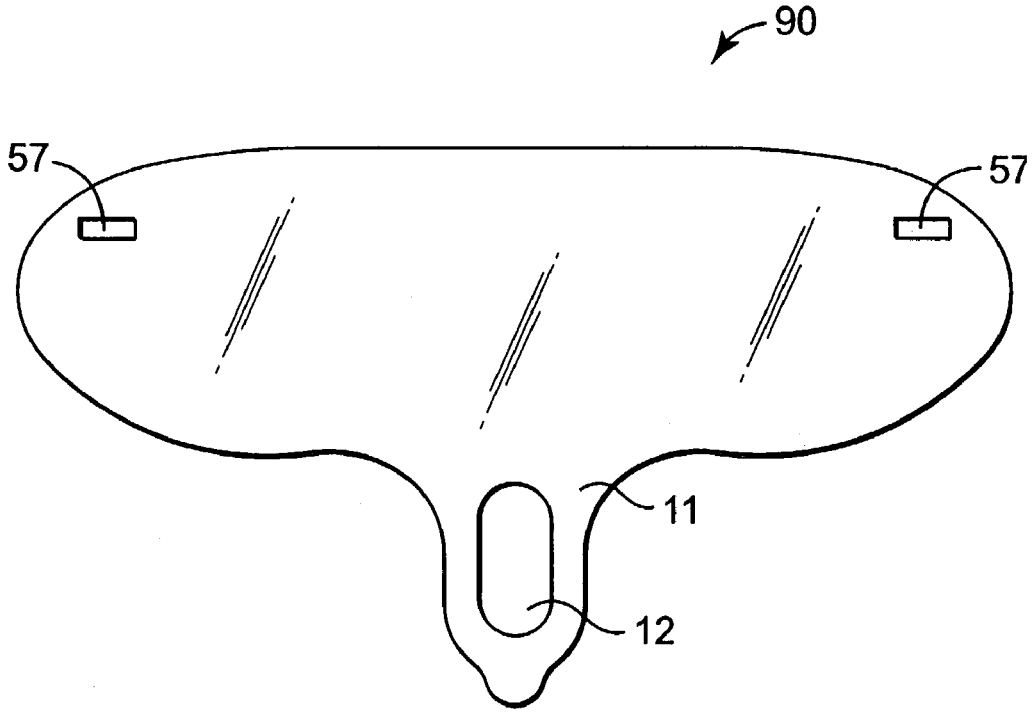
FIGS. 30 to 32 are front views of other eye-wear articles, in accordance with the invention.

FIG. 30 shows a further form of eye-wear article 90 that combines features of the eye-wear article 10 of FIG. 3 with features of the eye-wear article 55 of FIG. 22. In particular, the eye-wear article 90 has the downwardly-extending central portion 11 containing the aperture 12 that will fit over the exhalation valve 4 of the respiratory mask 1, together with slots 57 in the side edges that enable the eye-wear article to be slid up and down relative to the mask head harness 7 (possibly in combination with a sliding connector 60, 65 as described above with reference to FIGS. 19 and 20 or a clip as described with reference to FIG. 21 or 22).

Figure 29:
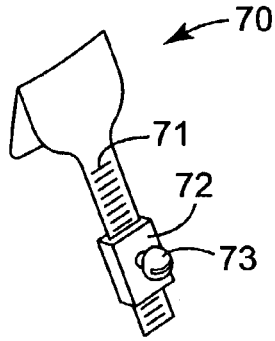
Figure 31:
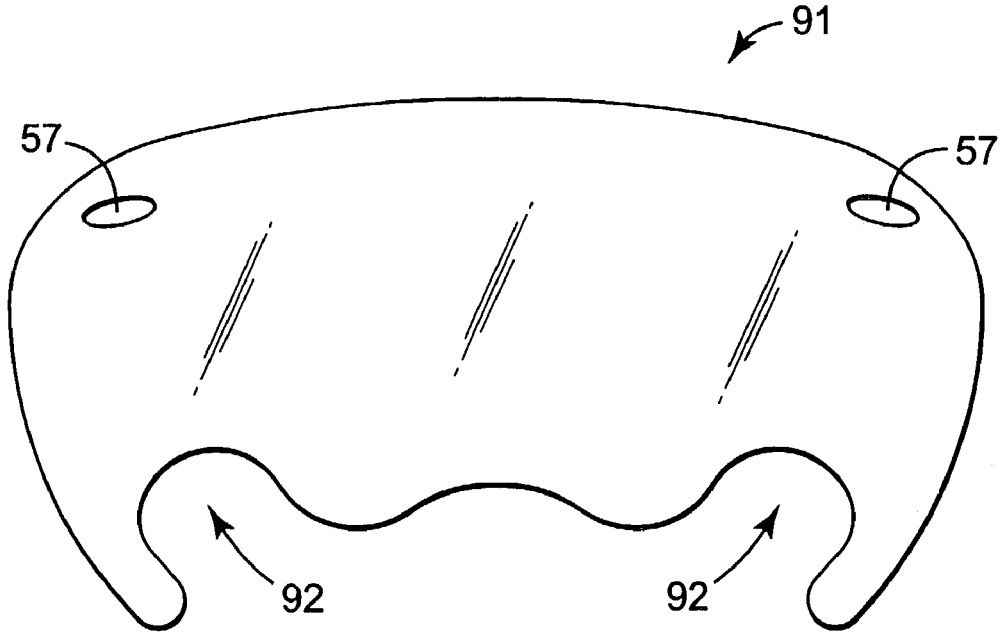

FIG. 31 shows an eye-wear article 91 which, like that of FIG. 30, has apertures 57 in the side edges that enable the eye-wear article to be slid up and down relative to the head harness of the respiratory mask, possibly in conjunction with sliding connectors as shown in FIGS. 24 and 25 or clips as shown in FIGS. 28 and 29. The eye-wear article 91 differs from that of FIG. 30 in that the lower edge is not shaped to engage around the exhalation valve 4 of the mask but, instead, to engage around the filter cartridges 5 on each side of the exhalation valve (see FIGS. 1 and 2). To that end, the lower edge of the eye-wear article 91 contains two cut-outs 92 forming mask-engaging positioning means that will fit over, and curve partly underneath, the filter cartridges 5 when the eye-wear article 91 is in the lowered position, but will permit the eye-wear article to be disengaged from the filter cartridges and slid upwards on the respirator headbands 7 to remove it from the wearer's line of sight. The shape of the cut-outs 92 can, of course, be modified as required to accommodate the shape of the filter cartridges on the mask with which the eye-wear article is to be used.

Figure 32:
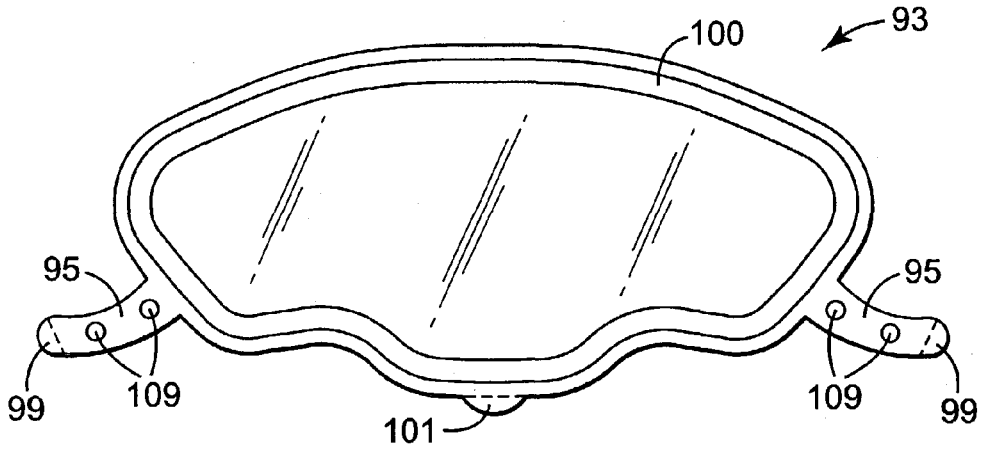
Figure 33:
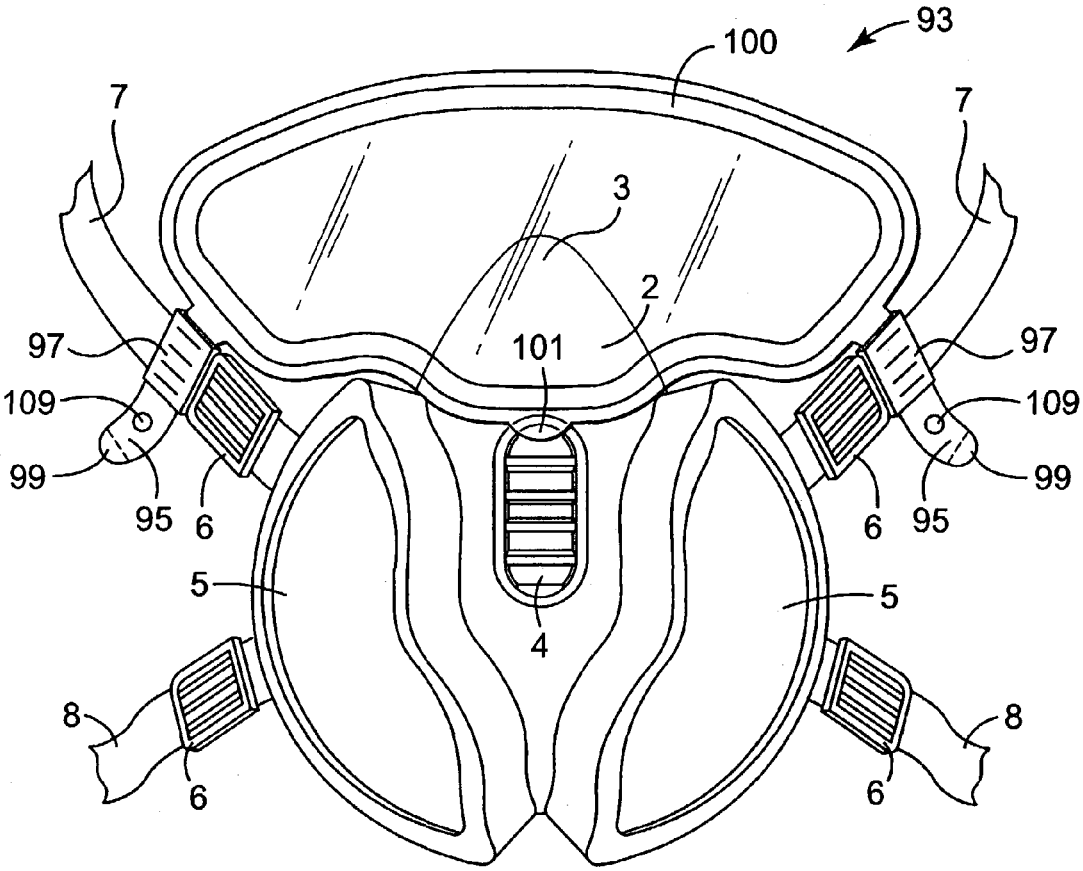
FIG. 33 shows the eye-wear article of FIG. 32 in position on the respiratory mask of FIG. 2.
Figure 34:
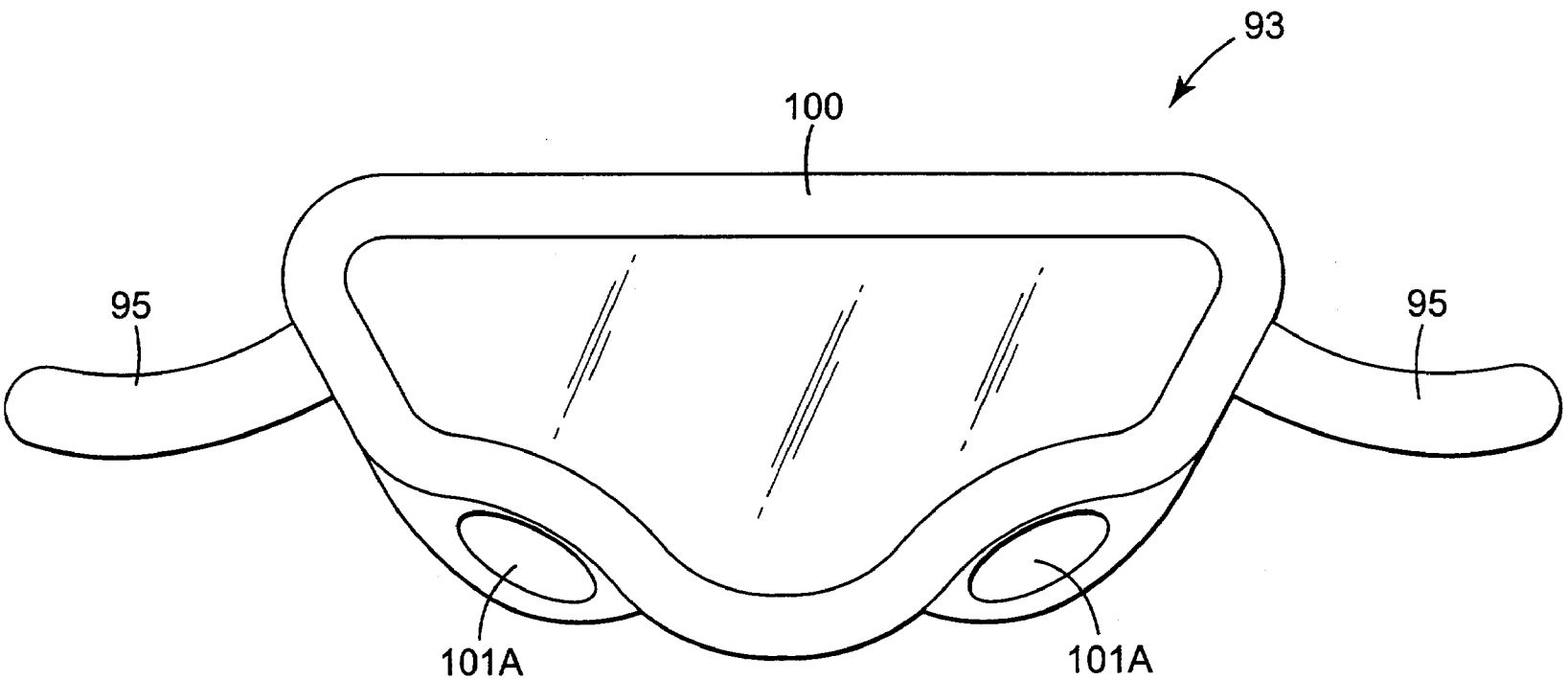
FIG. 34 shows a modified version of the eye-wear article of FIG. 32.

FIG. 32 shows yet another eye-wear article 93, suitable for use with the respiratory mask 1 of FIGS. 1 and 2, that remains in engagement with the mask headbands 7 when removed from the line of sight of the wearer. The eye-wear article has harness-engaging positioning means in the form of elongated tabs 95 that extend from each side edge and, in use, are threaded through respective guides 97 on the upper headbands 7 of the mask as shown in FIG. 33. The ends of the tabs 95 may be turned over, as indicated at 99, to help prevent the tabs from leaving the guides 97 during movement of the eye-wear article 93 as described below. The lower edge of the eye-wear article is shaped so that, when positioned in front of the eyes of the wearer, it will sit on the top of the exhalation valve structure 4 and fit neatly around the top of the two filter cartridges 5, as also shown in FIG. 33. To remove the eye-wear article 93 from the line of sight of the wearer, it is simply pushed upwards towards the top of the wearer's head. During this movement, the elongated tabs 95 slide upwards through the guides 97. The eye-wear article 93 can subsequently be pulled back down to the lowered position shown in FIG. 33, causing the elongated tabs 95 to slide back down through the guides 97. If necessary to accommodate the movement of the eye-wear article, the guides 97 can slide backwards and forwards along the mask headbands 7. A central tab 101 that projects forwards from the lower edge of the eye-wear article 93 assists in manipulating the eye-wear article and, in the lowered position, sits on the top of the exhalation valve structure as shown in FIG. 33. As an alternative, the central tab 101 could be replaced, or supplemented, by two tabs or finger holes/grips 101A on the lower edge of the eye-wear article, as shown in FIG. 34, adjacent the regions that fit around the top of the filter cartridges 5 on the mask 1.

The eye-wear article 92 carries a foam strip 100 that extends around the whole of its periphery on the side adjacent to the wearer's face. When the eye-wear article is in the lowered position, the foam strip 100 will provide protection against splashes that might otherwise reach the wearer's face through the gap between the face and the eye-wear article at the periphery of the latter. If required, the strip 100 may be configured to form a seal against the wearer's face.

Figure 35:
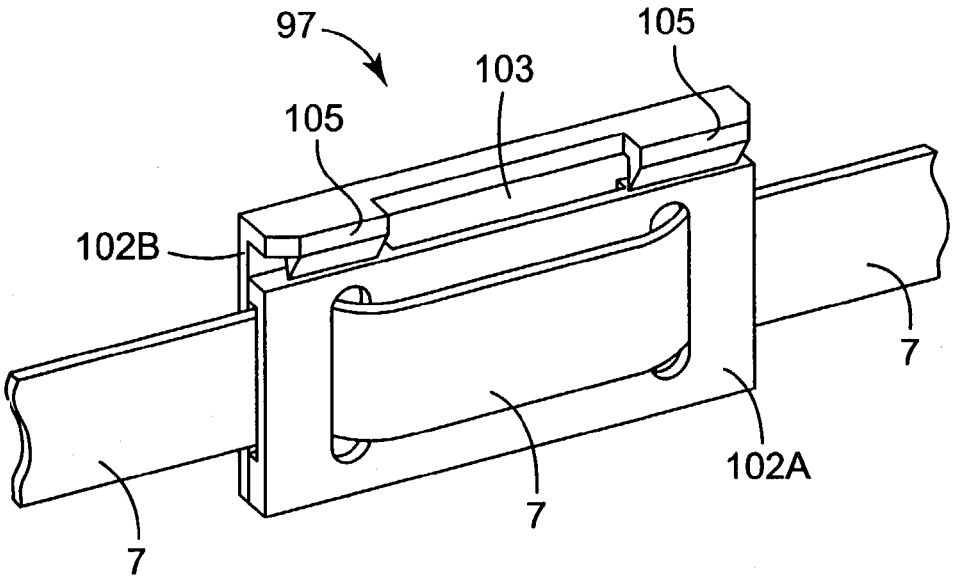
FIG. 35 shows a guide that is used on a headband of the mask of FIG. 33.
Figure 36:
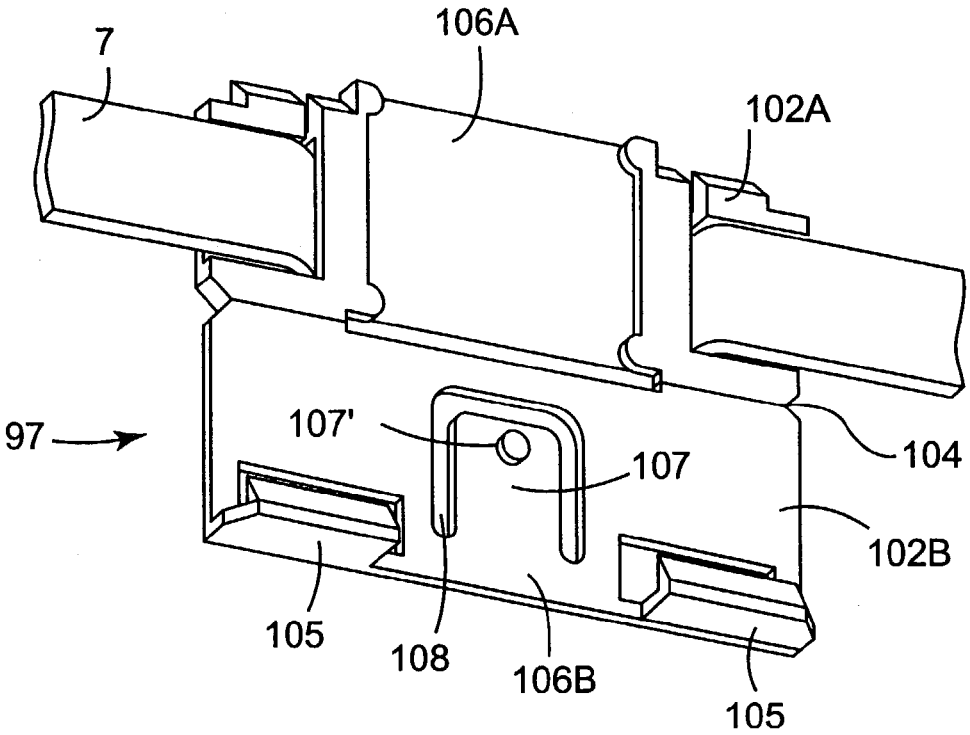
FIG. 36 shows the guide of FIG. 35 in an opened condition.

FIGS. 35 and 36 illustrate, in greater detail, a preferred form of the guides 97 on the upper headbands 7 of the mask shown in FIG. 33. The guide 97 of FIGS. 35 and 36 is formed in two parts 102A, 102B that, when closed together (as shown in FIG. 35), define between them a channel 103 which extends through the guide from one side to the other and through which, in use, one of the tabs 95 of the eye-wear article is threaded. The outer side of the part 102A of the guide 97 forms a buckle through which the mask headband 7 is threaded, as shown.

The parts 102A, 102B of the guide 97 are joined together along one side by a hinge and, in the closed position (FIG. 35) are held together at the other side by clips 105. The parts 102A, 102B could, as an alternative, be separate components held together by clips along both sides.

The channel 103 for the tab 95 of the eye-wear article is defined, within the guide 97, by opposed internal faces 106A, 106B on the parts 102A, 102B (see FIG. 36). A rectangular tongue 107 is formed in the face 106B of the channel 103 by a U-shaped slot 108 in the part 102B and, at the free end of the tongue 107 on its internal face, is semi-spherical button 107'. The button 107' is positioned to engage in one of two holes 109 in the eye-wear article tab 95, depending on whether the eye-wear article 93 is in the raised or lowered position, and thus functions to hold the eye-wear article in that position. The flexibility of the tongue 107 on which the button 107' is located permits the button to be moved out of engagement in the hole 109 when the eye-wear article tab 95 is being moved through the channel 103.

Eye-wear articles in accordance with the invention are not restricted to use with respiratory half masks having two filter cartridges disposed on either side of a centrally-located exhalation valve as shown in FIGS. 2 and 19. Through appropriate modification of its shape and manner of engagement with the respiratory mask and head harness, an eye-wear article in accordance with the invention can be used with other forms of half mask, including molded masks and fold flat masks, and with quarter masks (that is, masks that cover the nose and mouth, but not the chin, of the wearer). Eye-wear articles in accordance with the invention can also be used with respiratory masks having head harnesses of a different construction from those shown in FIGS. 2 and 19.

Preferably, the eye-wear article should not require the respiratory mask to be altered in any way although, as described with reference to FIGS. 16 and 18, some form of adapter may be needed in certain cases to modify the external shape of the valve structure of the mask.

Figure 37:
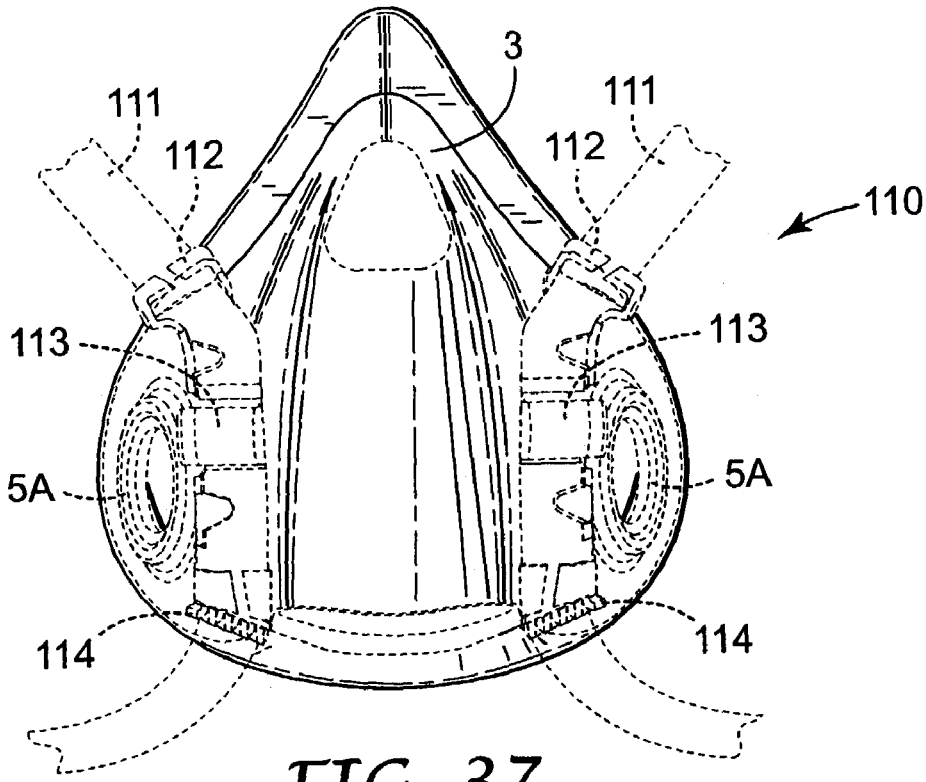
FIGS. 37 and 38 are front views of, respectively, another respiratory mask and an eye-wear article suitable for use on that mask.
Figure 38:
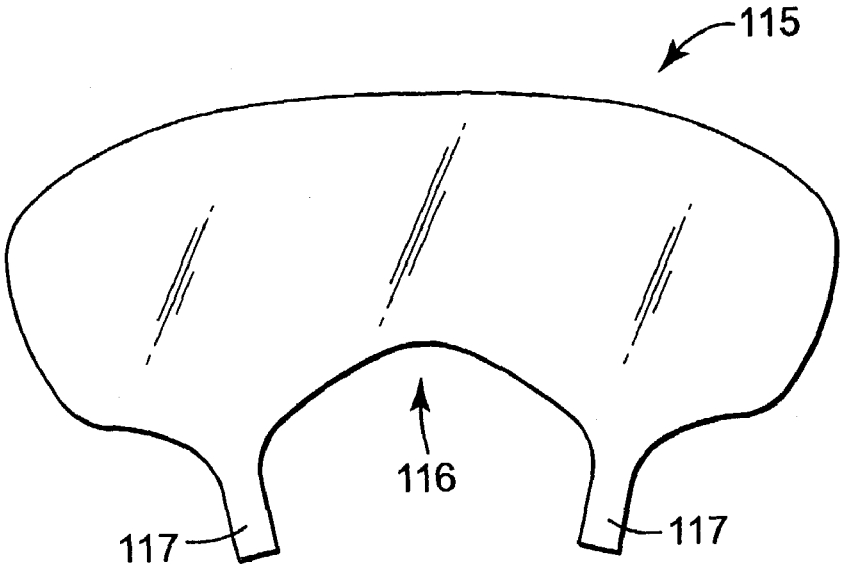

FIGS. 37 and 38 illustrate, by way of example, the use of an eye-wear article in accordance with the invention with a respiratory mask 110 that employs a different form of head harness. The mask 110, shown in FIG. 37, is similar to the masks 1, 49 of FIGS. 2 and 19 in that it has fittings 5A for two filter cartridges (omitted) disposed on either side of a central portion 3 that is intended to extend over the nose bridge of the wearer and contains an exhalation valve (not visible). In the mask 110, however, the upper and lower headbands 7, 8 and the respective attachments 6 of the masks 1, 49 are replaced by two longer headbands 111 (one on each side of the mask). These longer headbands 111 extend from the head cradle (not shown) of the head harness to the upper ends 112 of respective guideways 113 on the mask, in which they are carried around the front of the filter fittings 5A to leave at the lower ends 114 of the guideways and return to the back of the wearer's head.

An eye-wear article 115 suitable for use with the respiratory mask 110 is shown in FIG. 38. It comprises a flat, shaped piece of polymeric material that, like the eye-wear articles described previously, is intended to extend from the upper part of the mask 110 to cover the eye region of the wearer in both the horizontal and vertical directions. The central part 116 of the lower edge of the eye-wear article is shaped to locate on the central, nose bridge, portion 3 of the mask 110 forming mask-engaging positioning means for the eye-wear article in a similar manner to the central portion of the eye-wear article 55 of FIG. 23. On each side of the central part 116 is a downwardly extending elongated tab 117 that can be inserted into the respective headband guideway 113 from the upper end 112 and thus caused to engage the head harness of the mask 110. When in position on the mask, the eye-wear article 115 adopts a curved form across the eye region of the wearer, and can be provided with a strip of foam or other suitable material around the whole or part of its periphery to form a seal against the wearer's face and/or provide peripheral splash protection. The eye-wear article 115 can be removed at any time from the wearer's line of sight, without affecting the respiratory protection provided by the mask 110, by pulling the tabs 117 out of the headband guides 113.

Figure 39:
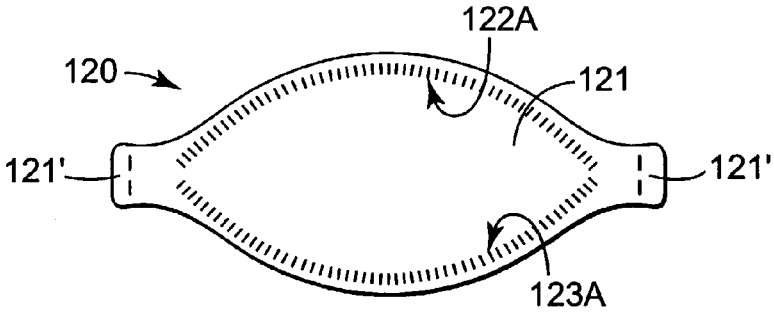
FIGS. 39 and 40 are front views of a fold-flat respiratory mask in, respectively, a folded and an opened position.
Figure 40:
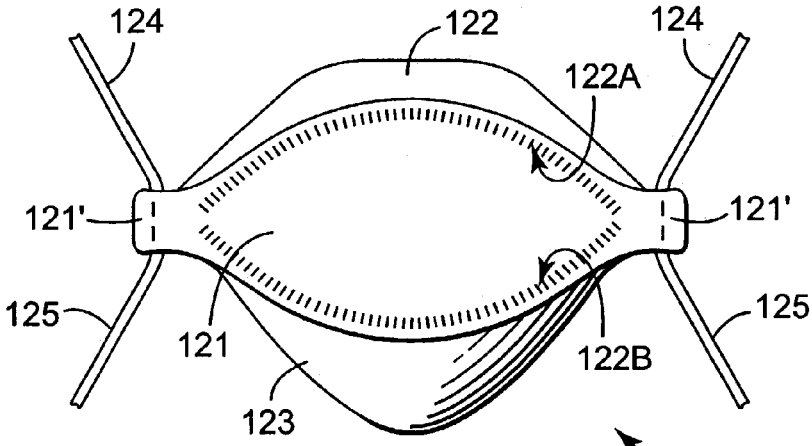
Figure 41:
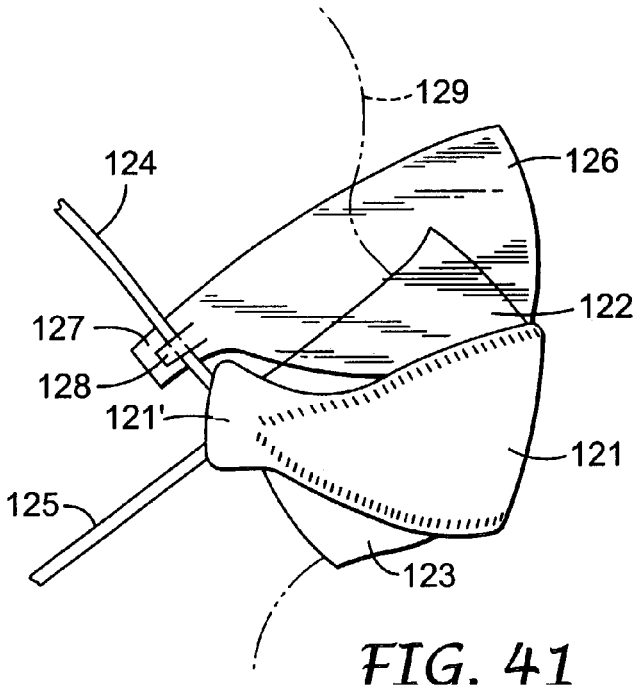
FIG. 41 is a side view illustrating the mask of FIGS. 39 and 40 in use with an eye-wear article.

FIGS. 39 to 41 illustrate, by way of example, the use of an eye-wear article in accordance with the invention on a fold flat mask. The mask 120, which is shown folded flat in FIG. 39 and opened in FIG. 40, comprises a central panel 121, and upper and lower panels 122, 123 that are joined to the central panel by respective welded seams 122A, 123A. Upper and lower headbands 124, 125 are secured to outwardly-extending tab portions 121[1] at the sides of the central panel 121. The upper and lower panels 122, 123 fold down behind the central panel 122 when the mask is folded flat (FIG. 39) but open up to form a cup-shaped face piece (FIG. 40) that will cover the nose, mouth and chin of the wearer. The panels 121, 122 and 123 are formed from any suitable air-permeable filtering material, through which air is drawn when the wearer inhales. Exhaled air may also leave the mask through the filtering material, or through an optional exhalation valve (not shown) provided in the central panel 121.

FIG. 41 shows a side view of the mask 120, in the opened state on the face 129 of a wearer, provided with an eye-wear article 126 in accordance with the invention. The eye-wear article 126 comprises a flat, shaped piece of comparatively thin and flexible polymeric material, the central part of the lower edge of which is shaped to sit in a dip formed, by the welded seam 122A, behind the upper edge of the central panel 121. The eye-wear article 126 has side-to-side dimensions such that its side portions 127 extend beyond the upper headband 124, enabling the side portions to be engaged with the upper headband 124 in any suitable way. FIG. 41 shows the side portion 127 of the eye-wear article 126 as formed with a rectangular tab 128 behind which the upper headband 124 is tucked but it will be appreciated that any of the arrangements described above with reference to FIGS. 5 to 8 could be used. The eye-wear article 126 can be detached completely from the mask 120 at any time, to remove it from the wearer's line of sight, without affecting the respiratory protection provided by the mask 120.

If desired, the eye-wear article 126 can be provided with clips (not shown), of any suitable construction, that can be used to secure the lower edge of the eye-wear article to the tabs 121' on each side of the mask 120.

Depending on the form of the respiratory mask with which it is to be used, an eye-wear article in accordance with the invention may be provided, along its lower edge, with a skirt of a suitable softer material that will lie against, and seal to, the outer surface of the mask.

The eye-wear articles described above with reference to the drawings can be manufactured comparatively easily and, through the appropriate selection of materials, can be fully disposable if they become marked or damaged. The material used for the visor portion of the eye-wear article would be chosen having regard to the circumstances in which it is to be intended for use. For example, in some circumstances, a coloured transparent material or a material designed to filter light of certain wavelengths might be desirable (including, for example, optical shielding materials known for use in welding visors). If required, any of the eye-wear articles can be provided with a strip of foam or other suitable material adjacent the whole or part of the outer edge of the visor portion, to form a seal against the face of the wearer and/or to provide peripheral splash protection if required. In each case, the use of the eye-wear article does not compromise or diminish the respiratory protection offered by the mask. If the eye-wear article is provided with a frame that extends along part, or the whole, of the periphery of the flat, transparent polymeric sheet material, the sheet material may be removable from, and replaceable in, the frame so that the latter can be retained even when the sheet material is discarded.

This invention may take on various modifications and alterations without departing from the spirit and scope thereof. Accordingly, it is to be understood that this invention is not to be limited to the above-described, but it is to be controlled by the limitations set forth in the following claims and any equivalents thereof. It is also to be understood that this invention may be suitably practiced in the absence of any element not specifically disclosed herein.

What is claimed is:

1. An eye-wear article for use with a respiratory mask provided with a head harness, the eye-wear article comprising:

a flat piece of transparent polymeric material providing a visor portion, mask-engaging positioning means, and harness-engaging positioning means, wherein the harness-engaging positioning means can be disengaged from the head harness while the mask is being worn, to permit the eye-wear article to be removed from the line of sight of the wearer while still remaining engaged with the mask, without disturbing the position of the mask on the wearer's face and without affecting the respiratory protection provided by the mask;

the mask-engaging positioning means and the harness-engaging positioning means being engageable, respectively, with the mask and with the head harness to cause the flat piece of polymeric material to adopt a curved configuration in which, when the mask is being worn, the piece of polymeric material extends from one side of the wearer's face to the other with the visor portion being located in front of the wearer's eyes;

wherein the eye-wear article can be disengaged from the mask and/or the head harness while the mask is being worn, to permit the article to be removed from the line of sight of the wearer without disturbing the position of the mask on the wearer's face and without affecting the respiratory protection provided by the mask.

2. The eye wear article of claim 1, in which the mask-engaging positioning means is formed in the flat piece of polymeric material.

3. The eye wear article of claim 1, in which the harness-engaging positioning means is formed in the fiat piece of polymeric material.

4. The eye-wear article of claim 1, wherein the mask-engaging positioning means includes at least one shaped portion formed in a lower edge of the flat piece of polymeric material to fit over a respective selected part of the mask.

5. The eye-wear article of claim 4 for use with a respiratory mask having a centrally-located exhalation valve, wherein the mask-engaging positioning means includes at least one shaped portion formed in a lower edge of the flat piece of polymeric material to fit over the exhalation valve structure.

6. The eye-wear article of claim 4 for use with a respiratory mask having filters on each side of a central portion of the mask, wherein the mask-engaging positioning means includes shaped portions formed in a lower edge of the flat piece of polymeric material to fit over the filters or the attachments of the filters to the mask.

7. The eye-wear article of claim 4 for use with a respiratory mask having a nose bridge, wherein the mask-engaging positioning means includes at least one shaped portion formed in a lower edge of the flat piece of polymeric material to fit over the nose bridge.

8. The eye-wear article of claim 1, for use with a respiratory mask having a nosebridge, wherein the mask-engaging positioning means includes a pre-formed nosepiece shaped to Sit on the nose bridge of the mask.

9. The eye-wear article of claim 1, wherein the harness-engaging positioning means includes portions at the sides of the flat piece of polymeric material that are shaped to fold around one or more headbands of the head harness.

10. The eye-wear article of claim 1, wherein the flat piece of polymeric material is formed with at least one hinge line to assist the curvature of the visor portion when the eye-wear article is in use on the respiratory mask.

11. The eye-wear article of claim 1, including a strip of sealing material extending at least partly around the periphery of the eye-wear article on the side adjacent the face of the wearer.

12. A respiratory half mask in combination with the eye-wear article of claim 1.

13. An eye-wear article for use with a respiratory mask having a centrally-located exhalation valve, and provided with a head harness, the eye-wear article comprising:

a flat piece of transparent polymeric material providing a visor portion, mask-engaging positioning means, and harness-engaging positioning means;

the mask-engaging positioning means and the harness-engaging positioning means being engageable, respectively, with the mask and with the head harness to cause the flat piece of polymeric material to adopt a curved configuration in which, when the mask is being worn, the piece of polymeric material extends from one side of the wearer's face to the other with the visor portion being located in front of the wearer's eyes;

wherein the eye-wear article can be disengaged from the mask and/or the head harness while the mask is being worn, to permit the article to be removed from the line of sight of the wearer without disturbing the position of the mask on the wearer's face and without affecting the respiratory protection provided by the mask; and wherein the mask-engaging positioning means includes an aperture, in the flat piece of polymeric material, that is shaped to locate over the exhalation valve structure.

14. The eye-wear article of claim 13, wherein the visor portion can pivot forwards, relative to the mask-engaging positioning means, to permit the eye-wear article to be removed from the line of sight of the wearer while still remaining engaged with the mask, without disturbing the position of the mask on the wearer's face and without affecting the respiratory protection provided by the mask.

15. An eye-wear article for use with a respiratory mask provided with a head harness, the eye-wear article comprising a flat piece of transparent flexible polymeric material, wherein the flat piece of transparent flexible polymeric material comprises:

a visor portion;

a downwardly-extending mask-engaging portion attached to the visor portion that is engageable with the respiratory mask; and harness-engaging portions attached to opposing edges of the visor portion along fold lines in the flat piece of transparent flexible polymeric material;

wherein the eye-wear article is detachable from the mask and the head harness while the mask is being worn.

16. The eye-wear article of claim 15 wherein when the eye-wear article is engaged with the respiratory mask and the bead harness, the eye-wear article adopts a curvature to conform to a wearer's face.

17. The eye-wear article of claim 15 wherein the respiratory mask comprises at least one filter disposed on each side of a central portion of the mask, wherein the downwardly-extending mask-engaging portion is engageable with the filter.

18. The eye-wear article of claim 15 wherein each harness-engaging portion is slidably engageable with a headband of the head harness.

19. The eye-wear article of claim 15 wherein when the eye-wear article is engaged with the mask and the head harness, the eye-wear article is spaced from a wearer's forehead.

20. A respiratory half mask in combination with the eye-wear article of claim 15.

21. An eye-wear article for use with a respiratory mask provided with a head harness, the eye-wear article comprising a flat piece of transparent flexible polymeric material, wherein the flat piece of transparent flexible polymeric material comprises:

a visor portion;

a downwardly-extending mask-engaging portion attached to the visor portion that is engageable with the respiratory mask; and harness-engaging portions attached to opposing edges of the visor portion along fold lines in the flat piece of transparent flexible polymeric material;

wherein the eye-wear article is detachable from the mask while the mask is being worn and removable from a wearer's line of sight while remaining engaged with the head harness.

22. The eye-wear article of claim 21 wherein when the eye-wear article is engaged with the respiratory mask and the head harness, the eye-wear article adopts a curvature to conform to a wearer's face.

23. The eye-wear article of claim 21 wherein the respiratory mask comprises at least one filter disposed on each side of a central portion of the mask, wherein the downwardly-extending mask-engaging portion is engageable with the filter.

24. The eye-wear article of claim 21 wherein each harness-engaging portion is slidably engageable with a headband of the head harness.

25. The eye-wear article of claim 21 wherein when the eye-wear article is engaged with the mask and the head harness, the eye-wear article is spaced from a wearer's forehead.

26. A respiratory half mask in combination with the eye-wear article of claim 21.

27. An eye-wear article for use with a respiratory mask provided with a head harness, the eye-wear article comprising a flat piece of transparent flexible polymeric material, wherein the flat piece of transparent flexible polymeric material comprises:

a visor portion;

a downwardly-extending mask-engaging portion attached to the visor portion that is engageable with the respiratory mask; and harness-engaging portions attached to opposing edges of the visor portion along fold lines in the flat piece of transparent flexible polymeric material;

wherein the respiratory mask comprises a centrally-located exhalation valve, and wherein the downwardly-extending mask-engaging portion comprises an aperture engageable with the exhalation valve.

28. The eye-wear article of claim 27 wherein when the eye-wear article is engaged with the respiratory mask and the head harness, the eye-wear article adopts a curvature to conform to a wearer's face.

29. The eye-wear article of claim 27 wherein the respiratory mask comprises at least one filter disposed on each side of a central portion of the mask, wherein the downwardly-extending mask-engaging portion is engageable with the filter.

30. The eye-wear article of claim 27 wherein each harness-engaging portion is slidably engageable with a headband of the head harness.

31. The eye-wear article of claim 27 wherein when the eye-wear article is engaged with the mask and the head harness, the eye-wear article is spaced from a wearer's forehead.

32. A respiratory half mask in combination with the eye-wear article or claim 27.

33. An eye-wear article for use with a respiratory mask provided with a head harness, the eye-wear article comprising a flat piece of transparent flexible polymeric material, wherein the flat piece of transparent flexible polymeric material comprises:

a visor portion;

a downwardly-extending mask-engaging portion attached to the visor portion that is engageable with the respiratory mask;

harness-engaging portions attached to opposing edges of the visor portion along fold lines in the flat piece of transparent flexible polymeric material; and hinge lines located at opposing edges of the visor portion intermediate the visor portion and the fold line.

34. The eye-wear article of claim 33 wherein when the eye-wear article is engaged with the respiratory mask and the head harness, the eye-wear article adopts a curvature to conform to a wearer's face.

35. The eye-wear article of claim 33 wherein the respiratory mask comprises at least one filter disposed on each side of a central portion of the mask, wherein the downwardly-extending mask-engaging portion is engageable with the filter.

36. The eye-wear article of claim 33 wherein each harness-engaging portion is slidably engageable with a headband of the head harness.

37. The eye-wear article of claim 33 wherein when the eye-wear article is engaged with the mask and the head harness, the eye-wear article is spaced from a wearer's forehead.

38. A respiratory half mask in combination with the eye-wear article of claim 33.

39. An eye-wear article for use with a respiratory mask provided with a head harness, the eye-wear article comprising a flat piece of transparent flexible polymeric material, wherein the flat piece of transparent flexible polymeric material comprises:

a visor portion;

a downwardly-extending mask-engaging portion attached to the visor portion that is engageable with the respiratory mask; and harness-engaging portions attached to opposing edges of the visor portion along fold lines in the flat piece of transparent flexible polymeric material; and at least one curved fold line extending across the top of the eye-wear article between the fold lines.

40. The eye-wear article of claim 39 wherein when the eye-wear article is engaged with the respiratory mask and the head harness, the eye-wear article adopts a curvature to conform to a wearer's face.

41. The eye-wear article of claim 39 wherein the respiratory mask comprises at least one filter disposed on each side of a central portion of the mask, wherein the downwardly-extending mask-engaging portion is engageable with the filter.

42. The eye-wear article of claim 39 wherein each harness-engaging portion is slidably engageable with a headband of the head harness.

43. The eye-wear article of claim 39 wherein when the eye-wear article is engaged with the mask and the head harness, the eye-wear article is spaced from a wearer's forehead.

44. A respiratory half mask in combination with the eye-wear article of claim 39.

* * * * *

UNITED STATES PATENT AND TRADEMARK OFFICE

CERTIFICATE OF CORRECTION

PATENT NO. : 7,077,128 B2
APPLICATION NO. : 10/611179
DATED : July 18, 2006
INVENTOR(S) : Audra A. Wilson It is certified that error appears in the above-identified patent and that said Letters Patent is hereby corrected as shown below:

Column 6
Line 27, after "mask" delete "I" and insert --1-- therefore.

Column 17
Line 60, in claim 3, delete "fiat" and insert --flat-- therefore.

Column 18
Line 19, in claim 8, delete "Sit" and insert --sit-- therefore.

Column 19
Line 15, in claim 16, delete "bead" and insert --head-- therefore.

Column 20
Line 32, in claim 32, delete "or" and insert --of-- therefore.

Signed and Sealed this

Twenty-eighth Day of November, 2006

JON W. DUDAS
*Director of the United States Patent and Trademark Office*